US011440715B2

(12) United States Patent
Rattanapaiboonchareon

(10) Patent No.: US 11,440,715 B2
(45) Date of Patent: Sep. 13, 2022

(54) CUP CARRIER

(71) Applicant: Jirasak Rattanapaiboonchareon, Tigard, OR (US)

(72) Inventor: Jirasak Rattanapaiboonchareon, Tigard, OR (US)

( * ) Notice: Subject to any disclaimer, the term of this patent is extended or adjusted under 35 U.S.C. 154(b) by 0 days.

(21) Appl. No.: 17/100,800

(22) Filed: Nov. 20, 2020

(65) Prior Publication Data

US 2021/0163199 A1 Jun. 3, 2021

Related U.S. Application Data

(63) Continuation-in-part of application No. 29/712,289, filed on Nov. 29, 2019, now Pat. No. Des. 944,655.

(60) Provisional application No. 62/965,550, filed on Jan. 24, 2020.

(51) Int. Cl.

| | |
|---|---|
| ***B65D 71/00*** | (2006.01) |
| ***B65D 71/54*** | (2006.01) |
| ***A47G 23/02*** | (2006.01) |
| ***B65D 71/50*** | (2006.01) |

(52) U.S. Cl.

CPC ..... *B65D 71/0007* (2013.01); *A47G 23/0208* (2013.01); *B65D 71/504* (2013.01); *B65D 2571/00456* (2013.01); *Y10S 229/904* (2013.01)

(58) Field of Classification Search

CPC ..... B65D 71/0007; B65D 71/504; B65D 2571/00456; B65D 21/0201; A47G 23/0208

USPC ..... 206/175–178; 220/23.4

See application file for complete search history.

(56) References Cited

U.S. PATENT DOCUMENTS

| | | | | |
|---|---|---|---|---|
| 2,371,317 | A * | 3/1945 | Ringler | B65D 71/0022 206/183 |
| 2,533,997 | A | 12/1950 | Cochrane | |
| 3,094,259 | A | 6/1963 | Diehl | |
| 3,298,563 | A | 1/1967 | Rabb | |
| 3,367,557 | A | 2/1968 | Farquhar | |
| 4,196,807 | A | 4/1980 | Brom | |
| D286,507 | S | 11/1986 | Drago | |
| D287,789 | S | 1/1987 | Johnson | |
| 4,799,723 | A | 1/1989 | Mahaffy | |
| 4,850,479 | A | 7/1989 | Bird | |
| 5,060,999 | A | 10/1991 | Marvin | |

(Continued)

FOREIGN PATENT DOCUMENTS

| | | |
|---|---|---|
| CN | 101801807 | 6/2012 |
| KR | 3020120033353 | 8/2012 |

(Continued)

OTHER PUBLICATIONS

English Translation of CN101801807, piublished Jun. 6, 2012.

(Continued)

*Primary Examiner* — Steven A. Reynolds
(74) *Attorney, Agent, or Firm* — Enterprise Patent LLC

(57) ABSTRACT

A cup carrier formed from a flexible sheet of material includes a base portion connected to a handle portion. Each of one or more cup-holding portions formed in the base portion includes a cup-holding aperture. The base portion includes one or more base fasteners that are mated to one or more base fasteners of another cup carrier. The handle portion includes one or more handle fasteners that are mated to one or more handle fasteners of another cup carrier.

32 Claims, 22 Drawing Sheets

(56) References Cited

U.S. PATENT DOCUMENTS

| | | | | |
|---|---|---|---|---|
| 5,069,335 | A * | 12/1991 | Beales | B65D 5/427 206/144 |
| 5,098,144 | A | 3/1992 | Marvin | |
| 5,267,644 | A | 12/1993 | Tsao | |
| 5,526,925 | A | 6/1996 | Bernstein | |
| 5,624,024 | A | 4/1997 | Miess | |
| 5,755,474 | A | 5/1998 | Slomski | |
| 5,927,502 | A | 7/1999 | Hunter | |
| 6,129,397 | A | 10/2000 | Borg | |
| 6,230,882 | B1 * | 5/2001 | Wischusen, III | B65D 71/004 206/183 |
| 6,561,353 | B2 * | 5/2003 | Levieux | A47G 7/025 206/423 |
| 8,091,702 | B1 * | 1/2012 | Keip | B65D 71/004 206/171 |
| D694,125 | S | 11/2013 | Holsmer | |
| D709,375 | S | 7/2014 | Smith | |
| D729,073 | S | 5/2015 | Wasileski | |
| D732,977 | S | 6/2015 | Booth et al. | |
| D781,158 | S | 3/2017 | Bosworth | |
| D786,702 | S | 5/2017 | Borg | |
| 9,932,160 | B2 * | 4/2018 | Smith | B65D 71/48 |
| 10,045,645 | B2 | 8/2018 | Kim | |
| D831,503 | S | 10/2018 | Borg et al. | |
| 10,532,868 | B2 | 1/2020 | Wintz | |
| D881,718 | S | 4/2020 | Bandinu | |
| D889,960 | S | 7/2020 | Kollias | |
| D918,057 | S | 5/2021 | L'Heureux | |
| D924,680 | S | 7/2021 | Johnson | |
| 2004/0134799 | A1 | 7/2004 | Mattson | |
| 2007/0199859 | A1 * | 8/2007 | Cook | B65D 5/46088 206/549 |
| 2008/0087558 | A1 | 4/2008 | Libit et al. | |
| 2008/0203204 | A1 | 8/2008 | Olsen | |
| 2009/0266872 | A1 * | 10/2009 | Fogle | B65D 71/16 229/100 |
| 2010/0096397 | A1 | 4/2010 | Weinberger | |
| 2011/0272299 | A1 | 11/2011 | Smith | |
| 2015/0353252 | A1 * | 12/2015 | Zammit | B65D 71/0022 206/427 |
| 2020/0189820 | A1 | 6/2020 | Smalley | |
| 2021/0163199 | A1 | 6/2021 | Rattanapaiboonchaoren | |

FOREIGN PATENT DOCUMENTS

| | | |
|---|---|---|
| KR | 101656733 | 9/2016 |
| KR | 10-2019-0041664 | 4/2019 |
| KR | 3020200015537 | 10/2020 |
| KR | 3020210012463 | 7/2021 |
| WO | 2013019834 | 2/2013 |

OTHER PUBLICATIONS https://www.amazon.com/Marketing-Holders-6-Compartment-12-Restaurants/dp/B082MTWVT9, downloaded Apr. 3, 2020. This image was availbale prior to the applicant's Nov. 29, 2019 filing date.

https://www.sixpackrings.com/8-PACK-RINGS/products/31/, downloaded Apr. 3, 2020. This image was availbale prior to the applicant's Nov. 29, 2019 filing date.

https://www.thinglink.com/scene/847929202605817863, downloaded Apr. 3, 2020. This image was availbale prior to the applicant's Nov. 29, 2019 filing date.

https://www.alibaba.com/product-detail/Plastic-6-Pack-Bottle-Carrier-for_255922063.html?spm=a2700.7724857.normalList.186.3a453a863zSMLL, downloaded Apr. 3, 2020. This image was availbale prior to the applicant's Nov. 29, 2019 filing date.

Splillable Drink Carriers (400 units Plain White). Online, published date unknown. Retrieved on Aug. 15, 2021 from URL: https://www.packgenie.co.uk/products/beer-carriers?variant=31601205674057.

UKIPO Search Report (dated Apr. 26, 2021).

100PCS Plastic Clear Handle Drink Containers Bags for Shops Stores Delivery Hanging Carry Take Out Beverage Doffer Milk Juice Water Tea Hole Liquid Pouches Single or Double Cups (Single Cup). Online, published date Aug. 10, 2020. Retrieved on Feb. 12, 2022 from URL: https://www.amazon.com/Plastic-Containers-Delivery-Han.

Coffee cup holder realistic mockup empty vector image. Online, published date unknown. Retrieved on Feb. 12, 2022 from URL: https://www.vectorstock.com/royalty-free-vector/coffee-cup-holder-realistic-mockup-empty-vector-19053796.

* cited by examiner

CUP CARRIER

CROSS REFERENCE TO RELATED APPLICATION

This application is a non-provisional application of U.S. Provisional Application No. 62/965,550, which was filed on Jan. 24, 2020, the contents of which are herein incorporated by reference in their entirety for all purposes, and this application is a continuation-in-part application of U.S. Design Application No. 29/715,289, which was filed on Nov. 29, 2019, the contents of which are herein incorporated by reference in their entirety for all purposes.

TECHNICAL FIELD

The field of this disclosure relates generally to cup carriers and, in particular, to sheet-formed cup carriers that can be connected to each other.

BACKGROUND INFORMATION

Cup carriers are employed carry up to a predetermined number of multiple cups. Traditionally, these cup carriers were bulky, expensive, and rigid cardboard or formed board trays having four three-dimensional cup holders. More recently, cup carriers have been made from plastic sheets containing four or six cup-engaging portions that support the tapered sidewalls of cups. These cup carriers are often provided at the point of sale with fewer drinks than the cup-engaging portions, such that one or more of the cup-engaging portions are empty.

OVERVIEW OF DISCLOSURE

One aspect of this disclosure relates to cup carriers formed from sheets of material.

Another aspect of this disclosure relates to cup carriers capable of being a connected to form a composite cup carrier.

In some embodiments, a cup carrier comprises a flexible sheet of material including a base portion connected to a handle portion; one or more cup-holding portions formed in the base portion; a cup-holding aperture formed within each of the cup-holding portions; one or more base fasteners formed within the base portion; and one or more handle fasteners formed within the handle portion.

In some additional, alternative, or selectively cumulative embodiments, a set of cup carriers comprises a first cup carrier comprising a first flexible sheet of material including a first base portion connected to a first handle portion, one or more first cup-holding portions formed in the first base portion, a first cup-holding aperture formed within each the first cup-holding portions, one or more first base fasteners formed within the first base portion, and one or more first handle fasteners formed within the first handle portion; and a second cup carrier comprising a second flexible sheet of material including a second base portion connected to a second handle portion, one or more second cup-holding portions formed in the second base portion, a second cup-holding aperture formed within each of the second cup-holding portions, one or more second base fasteners formed within the second base portion, and one or more second handle fasteners formed within the second handle portion, wherein the one of the first base fasteners is configured to be connectable to one of the second base fasteners, and wherein the one of the first handle fasteners is configured to be connectable to one of the second handle fasteners.

In some additional, alternative, or selectively cumulative embodiments, a method for assembling a composite cup carrier comprises obtaining a first cup carrier comprising a first flexible sheet of material including a first base portion connected to a first handle portion, one or more first cup-holding portions formed in the first base portion, a first cup-holding aperture formed within each of the first cup-holding portions, one or more first base fasteners formed within the first base portion, and one or more first handle fasteners formed within the first handle portion; obtaining a second cup carrier comprising a second flexible sheet of material including a second base portion connected to a second handle portion, one or more second cup-holding portions formed in the second base portion, a second cup-holding aperture formed within each of the second cup-holding portions, one or more second base fasteners formed within the second base portion, and one or more second handle fasteners formed within the second handle portion, wherein the one of the first base fasteners is configured to be connectable to one of the second base fasteners, and wherein the one of the first handle fasteners is configured to be connectable to one of the second handle fasteners; connecting the first and second base fasteners; and connecting the first and second handle fasteners to form the composite cup carrier.

In some additional, alternative, or selectively cumulative embodiments, the sheet of material has a thickness of 0.07 mm to 1.3 mm, of 0.12 mm to 0.8 mm, or of 0.2 mm to 0.5 mm.

In some additional, alternative, or selectively cumulative embodiments, the sheet of material comprises a substantially uniform thickness.

In some additional, alternative, or selectively cumulative embodiments, the sheet of material comprises different thicknesses.

In some additional, alternative, or selectively cumulative embodiments, the sheet of material comprises a recyclable material.

In some additional, alternative, or selectively cumulative embodiments, the sheet of material comprises a biodegradable material.

In some additional, alternative, or selectively cumulative embodiments, the sheet of material comprises a marine-degradable material.

In some additional, alternative, or selectively cumulative embodiments, the sheet of material comprises a material that is edible by an animal, mammal, livestock, or human.

In some additional, alternative, or selectively cumulative embodiments, the sheet of material is formed from a 3D printed material.

In some additional, alternative, or selectively cumulative embodiments, the sheet of material is molded.

In some additional, alternative, or selectively cumulative embodiments, the cup carrier is cut from an elongated sheet of material.

In some additional, alternative, or selectively cumulative embodiments, the cup carrier includes one cup-holding portion.

In some additional, alternative, or selectively cumulative embodiments, the cup carrier includes multiple cup-holding portions.

In some additional, alternative, or selectively cumulative embodiments, the cup carrier is a first cup carrier that comprises a first flexible sheet of material including one or more first cup-holding portions connected to a first handle portion, a first cup-holding aperture formed within the first cup-holding portion, one or more first base fasteners formed within the first cup-holding portion, and one or more first handle fasteners formed within the first handle portion, wherein the cup carrier further comprises a second cup carrier comprising a second flexible sheet of material including one or more second cup-holding portions connected to a second handle portion, a second cup-holding aperture formed within the second cup-holding portion, one or more second base fasteners formed within the second cup-holding portion, and one or more second handle fasteners formed within the second handle portion, wherein the one of the first base fasteners is configured to be connectable to one of the second base fasteners, and wherein the one of the first handle fasteners is configured to be connectable to one of the second handle fasteners.

In some additional, alternative, or selectively cumulative embodiments, the first cup carrier and the second cup carrier have a different number of cup-holding portions.

In some additional, alternative, or selectively cumulative embodiments, the first cup carrier and the second cup carrier have a different number of cup-holding apertures.

In some additional, alternative, or selectively cumulative embodiments, the first cup carrier and the second cup carrier have the same number of cup-holding portions.

In some additional, alternative, or selectively cumulative embodiments, the first cup carrier and the second cup carrier have the same number of cup-holding apertures.

In some additional, alternative, or selectively cumulative embodiments, the first and second handle fasteners comprise different ones of a mated pair of fasteners.

In some additional, alternative, or selectively cumulative embodiments, the first and second base fasteners comprise different ones of a mated pair of fasteners.

In some additional, alternative, or selectively cumulative embodiments, the handle portion comprises multiple handle fasteners.

In some additional, alternative, or selectively cumulative embodiments, the handle portion comprises at least two different types of fasteners.

In some additional, alternative, or selectively cumulative embodiments, the base portion comprises multiple base fasteners.

In some additional, alternative, or selectively cumulative embodiments, the base portion comprises at least two different types of fasteners.

In some additional, alternative, or selectively cumulative embodiments, the first and second handle fasteners comprise different ones of tabs and slots.

In some additional, alternative, or selectively cumulative embodiments, the first and second base fasteners comprise different ones of tabs and slots.

In some additional, alternative, or selectively cumulative embodiments, the handle portion comprises different ones of tabs and slots.

In some additional, alternative, or selectively cumulative embodiments, the base portion comprises different ones of tabs and slots.

In some additional, alternative, or selectively cumulative embodiments, the first cup carrier and the second cup carrier have a total number of cup-holding apertures that is an odd number.

In some additional, alternative, or selectively cumulative embodiments, the cup-holding aperture defines multiple cup-holding flaps.

In some additional, alternative, or selectively cumulative embodiments, the cup-holding aperture defines multiple aperture recesses.

In some additional, alternative, or selectively cumulative embodiments, the cup-holding aperture defines multiple aperture recesses, and wherein the cup-holding portion comprises one or more fold holes between neighboring aperture recesses.

In some additional, alternative, or selectively cumulative embodiments, the cup-holding aperture defines multiple aperture recesses, wherein the cup-holding portion comprises a fold hole equally spaced between neighboring aperture recesses.

In some additional, alternative, or selectively cumulative embodiments, the cup-holding aperture defines multiple cup-holding flaps and multiple aperture recesses, wherein each of the cup-holding flaps has a top, wherein each of the aperture recesses has a bottom, and wherein the cup-holding portion comprises a fold hole that is closer to the bottoms of neighboring aperture recesses than it is to the tops of neighboring cup-holding flaps.

In some additional, alternative, or selectively cumulative embodiments, the cup-holding aperture defines multiple aperture recesses, wherein the aperture recesses have a bottom, wherein the cup-holding portion comprises a fold hole at least partly aligned between the bottoms of neighboring aperture recesses.

In some additional, alternative, or selectively cumulative embodiments, the base portion or the handle portion contains printed advertisements.

Selectively cumulative embodiments are embodiments that include any combination of multiple embodiments that are not mutually exclusive.

Additional aspects and advantages will be apparent from the following detailed description of example embodiments, which proceeds with reference to the accompanying drawings.

DETAILED DESCRIPTION OF EMBODIMENTS

Figure 1:
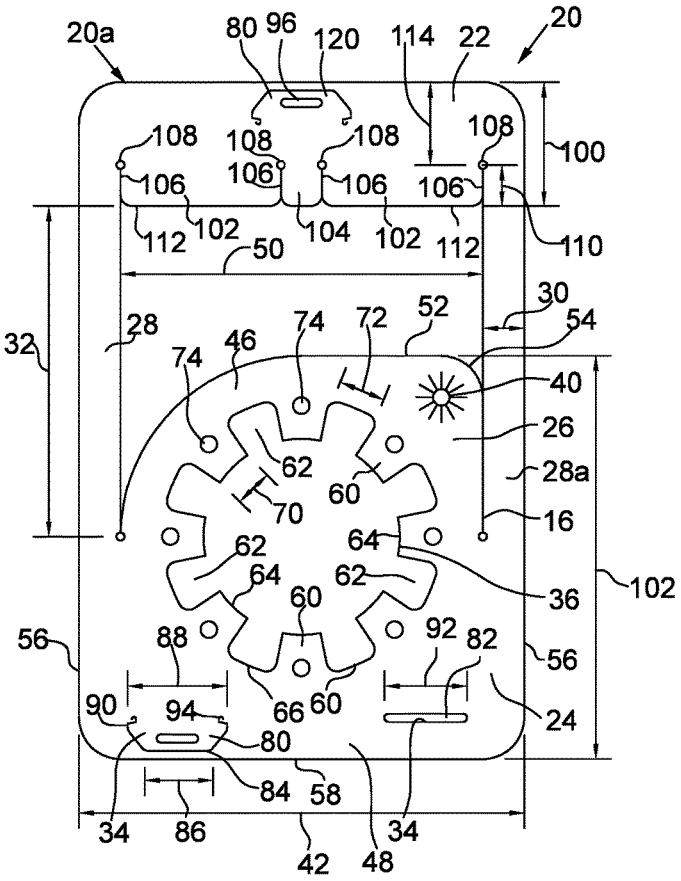
FIG. 1 is a top plan view showing an embodiment of a single cup carrier including a handle portion and a base portion that has a single cup-holding portion (and the bottom view may be a mirror image of the top plan view).

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing particular example embodiments only and is not intended to be limiting. As used herein, the singular forms "a," "an" and "the" are intended to include the plural forms as well, unless the context clearly indicates otherwise. It should be recognized that the terms "comprise," "comprises," "comprising," "includes," "include," "including," "have," "has," and having" when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the exemplary term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein.

Figure 3:
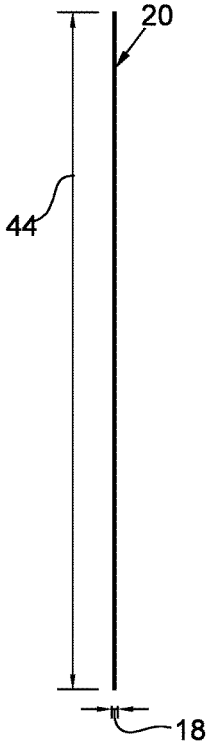
FIG. 3 is a right side elevation view of the cup carrier of FIG. 1 (and the left side elevation view may be an identical image of the right side elevation view).
Figure 2:
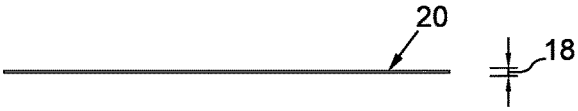
FIG. 2 is a front elevation view of the cup carrier of FIG. 1 (and the rear elevation view may be an identical image of the front elevation view).
Figure 4:
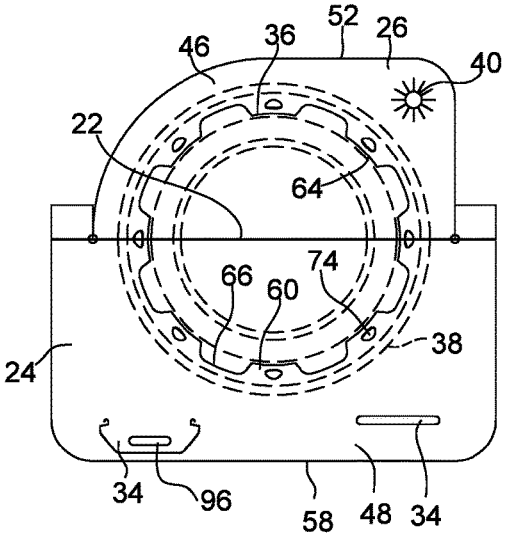
FIG. 4 is top plan view of the cup carrier of FIG. 1, shown in a folded arrangement with the handle portion arranged in a transverse direction to the cup-holding portion.
Figure 5:
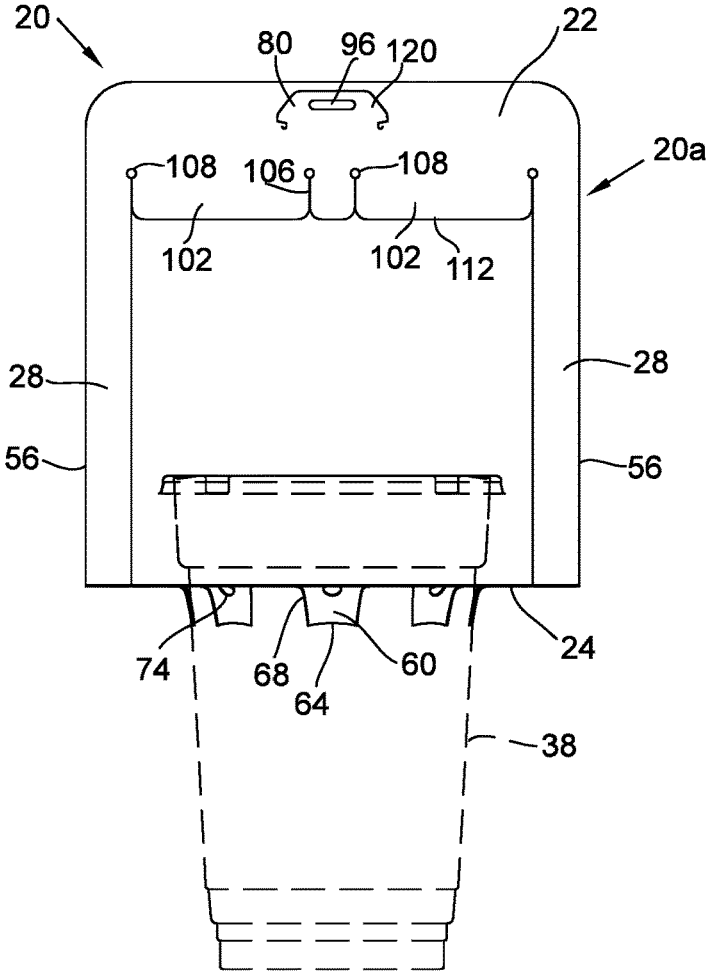
FIG. 5 is a front elevation view of the cup carrier of FIG. 1, shown in a folded arrangement with the handle portion arranged in a transverse direction to the cup-holding portion (and the rear elevation view of the folded arrangement may be an identical image of the front elevation view of the folded arrangement).
Figure 6:
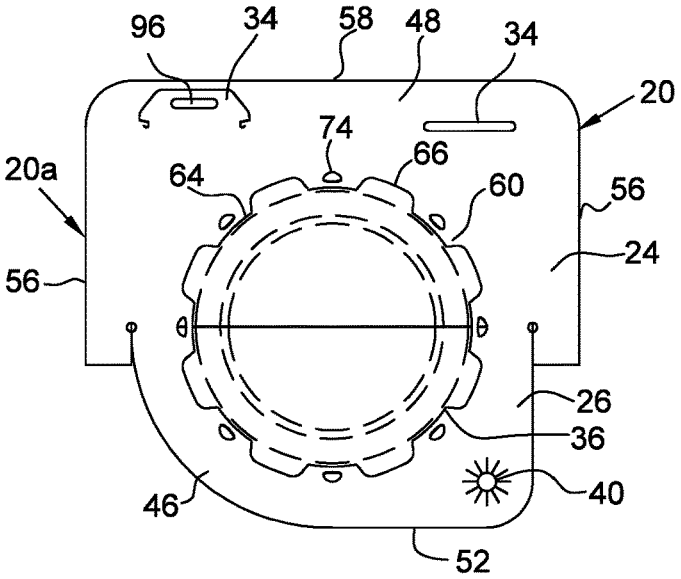
FIG. 6 is bottom view of the cup carrier of FIG. 1, shown in a folded arrangement with the handle portion arranged in a transverse direction to the cup-holding portion.
Figure 7:
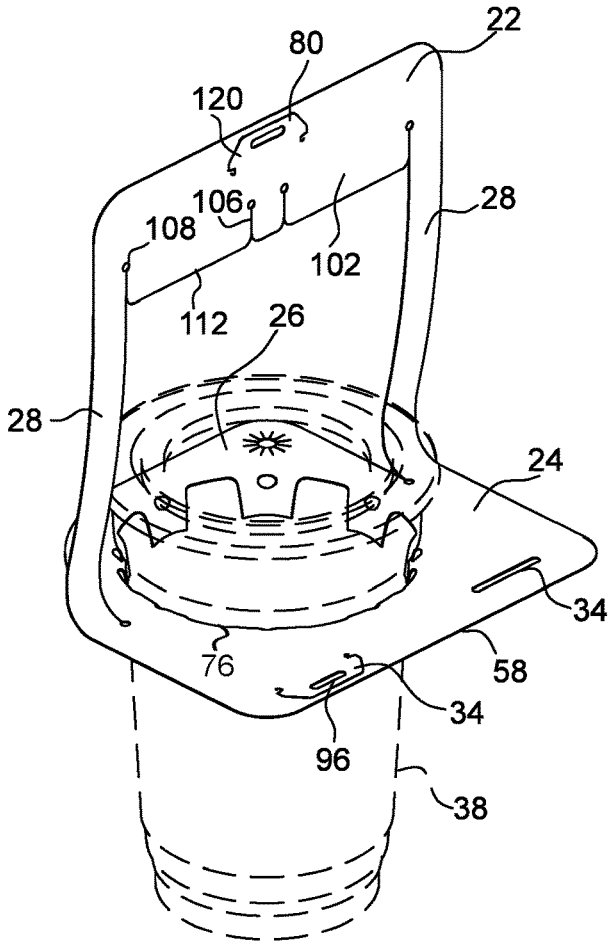
FIG. 7 is an isometric view of the cup carrier of FIG. 1, shown in a folded arrangement with the handle portion arranged in a transverse direction to the cup-holding portion.
Figure 8:
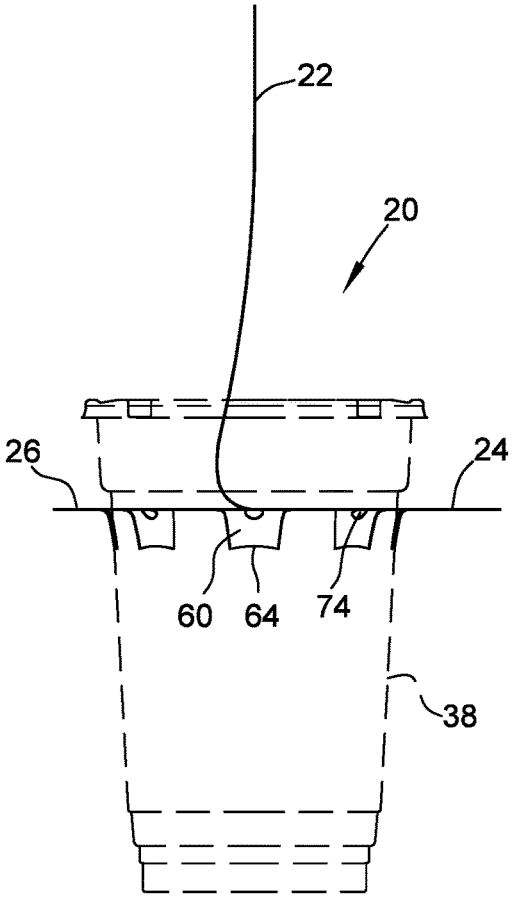
FIG. 8 is a right side elevation view of the cup carrier of FIG. 1, shown in a folded arrangement with the handle portion arranged in a transverse direction to the cup-holding portion (and the left side elevation view of the folded arrangement is an identical image of the right side elevation view of the folded arrangement).

FIG. 1 is a top plan view (and the bottom view is a mirror image of the top plan view) showing an embodiment of a cup carrier 20, particularly a single-cup carrier 20*a*, which includes a handle portion 22 and base portion 24 that has a single cup-holding portion 26. FIG. 2 is a front elevation view of the cup carrier 20*a* of FIG. 1 (and the rear elevation view is an identical image of the front elevation view), and FIG. 3 is a right side elevation view of the cup carrier 20*a* of FIG. 1 (and the left side elevation view is an identical image of the right side elevation view). FIG. 4 is top plan view of the cup carrier 20 of FIG. 1, shown in a folded arrangement with the handle portion 22 arranged in a transverse direction to the base portion 24; FIG. 5 is a front elevation view of the cup carrier 20 of FIG. 1, shown in a folded arrangement with a handle portion 22 arranged in a transverse direction to the base portion 24 (and the rear elevation view of the folded arrangement is an identical image of the front elevation view of the folded arrangement); FIG. 6 is bottom view of the cup carrier 20 of FIG. 1, shown in a folded arrangement with a handle portion 22 arranged in a transverse direction to the base portion 24; FIG. 7 is an isometric view of the cup carrier 20 of FIG. 1, shown in a folded arrangement with a handle portion 22 arranged in a transverse direction to the base portion 24; and FIG. 8 is a right side elevation view of the cup carrier 20 of FIG. 1, shown in a folded arrangement with a handle portion 22 arranged in a transverse direction to the base portion 24 (and the left side elevation view of the folded arrangement is an identical image of the right side elevation view of the folded arrangement).

With reference to FIGS. 1-3, the cup carrier 20 may be formed from a flexible sheet material that may have a thickness 18 that may be more than 50 percent thinner than conventional cup carrier made from cardboard or formed board. The sheet of material may have a thickness of 0.07 mm to 1.3 mm, a thickness of 0.12 mm to 0.8 mm, or a thickness of 0.2 mm to 0.5 mm. Laminated paper may have a thickness closer to 1 mm, while plastic material may have a thickness that is typically less than 0.5 mm. The sheet may have a substantially uniform thickness. However, the handle portion 22 and the base portion 24 may have the same thickness or different thicknesses. The cup carrier 20 may also include different materials in different portions of the sheet.

Suitable strengths for the sheet material may be characterized by the Young's modulus, tensile strength, and/or elongation-to-break ratio. A suitable Young's modulus for the sheet material may range from a lower limit of about 0.1 GPa, 0.5 GPa, or 1 GPa to an upper limit of about 10 GPa, 7 GPa, 5 GPa, or 3 GPa as measured by ASTM D-882, wherein the Young's modulus may range from any lower limit to any upper limit and encompass any subset therebetween. A suitable tensile strength for the sheet material may range from a lower limit of about 10 MPa, 15 MPa, or 25 MPa to an upper limit of about 100 MPa, 85 MPa, 75 MPa, or 50 MPa as measured by ASTM D-882, wherein the tensile strength may range from any lower limit to any upper limit and encompass any subset therebetween. A suitable elongation-to-break ratio for the sheet material may range from a lower limit of about 10%, 50%, 100%, or 250% to an upper limit of about 700%, 500%, or 250% as measured by ASTM D-882, wherein the elongation-to-break ratio may range from any lower limit to any upper limit and encompass any subset therebetween. A suitable crystallinity (in examples where crystallinity is desirable) for the sheet material may range from a lower limit of about 0.1%, 1%, 5%, or 10% to an upper limit of about 50%, 25%, 15%, or 10% as measured by AST E-793-06, wherein the crystallinity may range from any lower limit to any upper limit and encompass any subset therebetween. A suitable melt temperature for a sheet material may range from a lower limit of about −17° C., 93° C., 121° C., or 148° C. to an upper limit of about 232° C., 205° C., 177° C., or 150° C. as measured by ASTM E-794-06, wherein the melting temperature may range from any lower limit to any upper limit and encompass any subset therebetween. One will appreciate that these characteristics represent only some examples, and the sheet material may have characteristics outside these ranges, such as above or below the ranges provided in these examples.

The sheet material may be cellulosic, polymeric, plastic, or other material, or combinations thereof. Examples of cellulosic materials may include paper or paperboard coated with polyethylene.

The plastic or polymeric material may contain a polyolefin, such as a high-density polyethylene that has a tensile strength from about 27,000 kPa to about 35,000 kPa, a flexural strength of at least 425 kPa and a brittleness temperature of less than −50° C. This material is easily recyclable.

Alternatively (or additionally), the plastic or polymeric material may contain a high-pressure low-density (or medium-density) polyethylene polymer that provides improved recovery after stretch, improved elongation and strength at break, and improved resistance to tearing when the cup carrier 20 is notched or scratched. The low-density polyethylene polymer may have a density of about 0.910-0.950, grams/cm$^3$, about 0.920-0.940 grams/cm$^3$, or about 0.925-0.935 grams/cm$^3$.

Alternatively (or additionally), the plastic or polymeric material may contain a marine-degradable polymer. Some of these marine-degradable polymers at least partially includes poly(butylene succinate), any derivative thereof, and any combination thereof or at least one monomer unit of succinic acid, 1,4-butanediol, any derivative thereof, and any combination thereof. The marine-degradable composition may comprise a polymer that is a linear homopolymer or copolymer, a crosslinked homopolymer or copolymer, a block copolymer, an interpolymers, an alternating copolymer, a periodic copolymer, a random polymer, a branched homopolymer or copolymer, a graft copolymer, a star copolymer, a brush copolymer, a comb copolymer, a blend polymer, and any combination thereof. Marine-degradable polymers are described in detail in International Publication No. WO 2013/019834 corresponding to International Application No. PCT/US2012/04911, which is incorporated herein by reference.

Alternatively (or additionally), the sheet material may contain a material that is edible by humans, mammals, birds, or insects, either collectively or individually.

The sheet material can be made by molding or casting with most or all of the aperture features removed. Alternatively, the sheet material can be formed in single sheets or a long continuous sheet and die cut to remove the material from the aperture features. In most circumstances, the cut material can be re-used or recycled. Alternatively, the sheet material can be made in advance or on-demand by 3D printing, such as at the point-of-sale, with most or all of the aperture features removed so there is no waste material.

With reference again to FIGS. 1-3, the sheet may have (or may be cut to) a standard paper size such as 8.5" (21.6 cm)×11" (27.9 cm), 11" (27.9 cm)×17" (43.2 cm). More generally, the sheet may have (or may be cut to) a sheet width 42 (between sheet side edges 56) that is less than or equal to about 12" (31 cm) or less than or equal to about 10" (25 cm), and the sheet may have (or may be cut to) a sheet length 44 that is less than or equal to about 20" (50 cm) or less than or equal to about 12" (31 cm).

The handle portion 22 and the base portion 24 may be connected by one or more straps 28 that may have a strap width 30 that is shorter than a strap length 32. A desirable minimum strap width 30 may depend on the cup sizes, the type of material, and its thickness. The strap length 32 may be greater than or equal to one half of the sheet length 44. However, the strap length 32 may be shorter than or equal to one half of the sheet length 44.

The straps 28 will typically be configured to have the same strap length 32. The minimum strap length 32 may be at least the radius of the lid of a cup 38. A strap length 32 that is greater than the diameter of the lid of a cup 38 may be useful for fastening two handle portions 22 together when connecting cup carriers 20 and may also provide good stability. Up to an inconvenient distance between a customer's hand and the base portion 24, a longer strap length 32 may provide more stability.

The edges of the straps 28 may be linear, or they may be curved. One or more of the straps 28 may be separated from the cup-holding portion 26 by a strap slit 16, which may be a mere cut line or may be large enough to provide a gap between the strap 28 and the from the cup-holding portion 26. The straps 28 may have the same thicknesses or different thicknesses from those of the handle portion 22 and the base portion 24.

Figure 29:
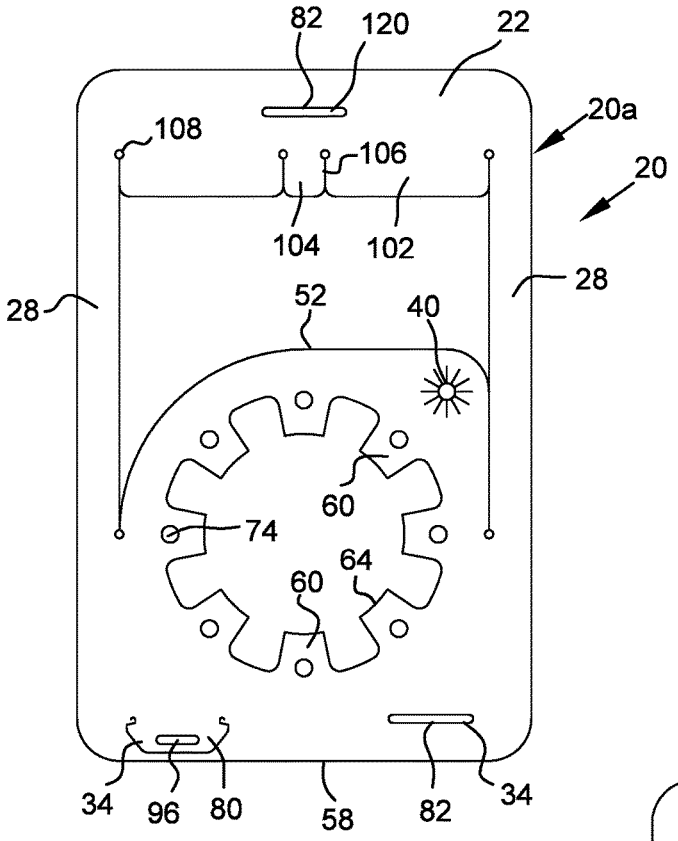
FIG. 29 is a top plan view of a first alternative embodiment of the single cup carrier of FIGS. 1-8, in which a slot is shown that can be substituted for a tab in FIGS. 1-8 (and the bottom view may be a mirror image of the top plan view).
Figure 30:
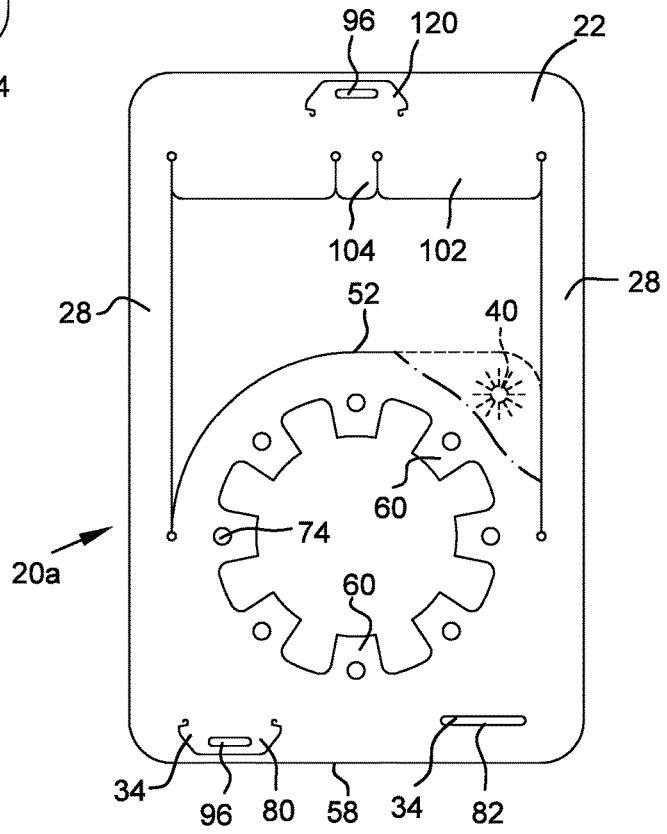
FIG. 30 is a top plan view of a second alternative embodiment of the single cup carrier of FIGS. 1-8 and 29, in which the shape of the cup-holding portion may be modified to exclude an auxiliary aperture (such as a straw holder) in FIGS. 1-8 and 29 (and the bottom view may be a mirror image of the top plan view).

The base portion 24 may include one or more cup-holding portions 26 and one or more base fasteners 34. The entirety of the cup-holding portion(s) 26 may be within the base portion 24. Part of the cup-holding portion 26 may be positioned within a free region 46 of the base portion 24, and part of the cup-holding portion 26 may be positioned within a supported region 48 (or fastener region 48) of the base portion 24. In some embodiments, about half of the cup-holding portion 26 is positioned within the free region 46 and about half of the cup-holding portion 26 is positioned within the supported region 48. One will appreciate, however, that the majority of the cup-holding portion 26 can be positioned within the supported region 48, or the majority of the cup-holding portion 26 can be positioned within the free region 46. The free region 46 may have a free edge 52 that may be symmetrical or asymmetrical. The free edge 52 may be curved or linear and have multiple segments or take a continuous non-segmented shape. The free edge 52 may have one or more rectangular or curved corners 54. FIG. 30 is a top plan view of an alternative embodiment of the single cup carrier 20*a* of FIGS. 1-8 and 29, in which the shape of the free edge 52 of the free region 46 of the cup-holding portion 50 of the base portion 24 may be configured to exclude the auxiliary aperture 40 as shown by the broken lines and boundary lines.

The supported region 48 may have a base portion width that is typically the same size as the sheet width 42, but the base portion width may be smaller than the sheet width. The supported region 48 may have a base portion width that is wider than a cup-holding portion width 50 of the cup-holding portion 26 of the free region 46. Moreover, the cup-holding portion 26 of the base portion 24 may have a cup-holding portion width 50 that is less than the base portion width and the sheet width 42.

Each of the cup-holding portions 26 may include a cup-holding aperture 36 for holding a cup 38 (FIGS. 4-8) and an auxiliary aperture 40 for holding an auxiliary item such as straw or a utensil, such as a stirrer or honey stick. Each cup-holding aperture 36 may define multiple cup-holding flaps 60 and multiple aperture recesses 62. The cup-holding flaps 60 may be identical to each other, or some or all may be different from each other. Similarly, the aperture recesses 62 may be identical to each other, or some or all may be different from each other. Each of the cup-holding flaps 60 may have a top 64, and each of the aperture recesses 62 may have a bottom 66. The top 64 may have a top length 70 that is shorter than or equal to a bottom length 72 of the recess bottom 66. The cup-holding flaps 60 and the aperture recesses 62 may share side walls 68. When holding a cup 38, the cup-holding aperture 36 may exhibit a substantially circular cup-holding aperture profile 76, as shown in FIG. 7 (and FIGS. 14, 18, and 24).

Figure 31:
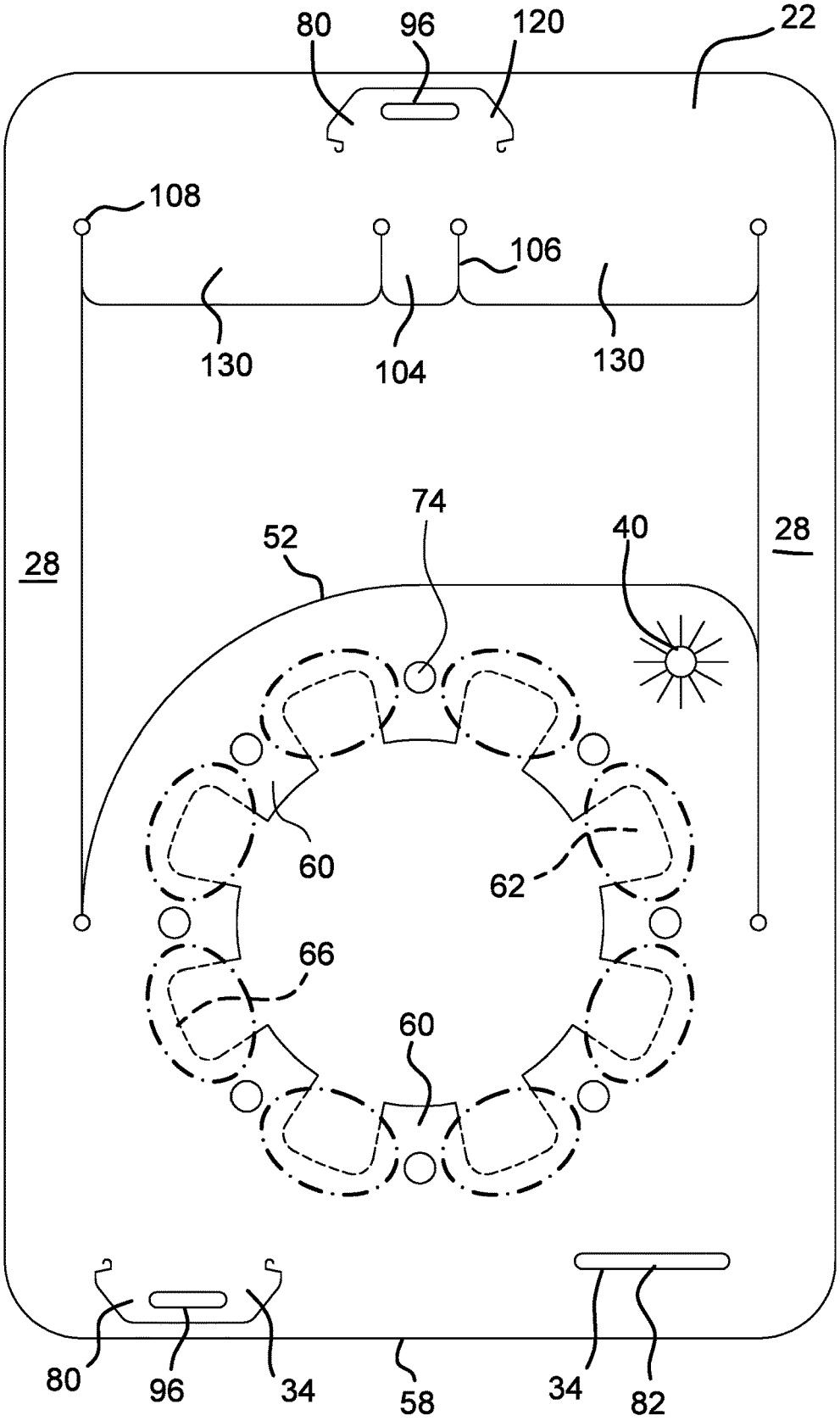
FIG. 31 is a top plan view of a third alternative embodiment of the single cup carrier of FIGS. 1-8, 29, and 30 in which the shape of recesses surrounding flaps of the cup-holding portion may be modified in FIGS. 1-8, 29, and 30 (and the bottom view may be a mirror image of the top plan view).
Figure 32:
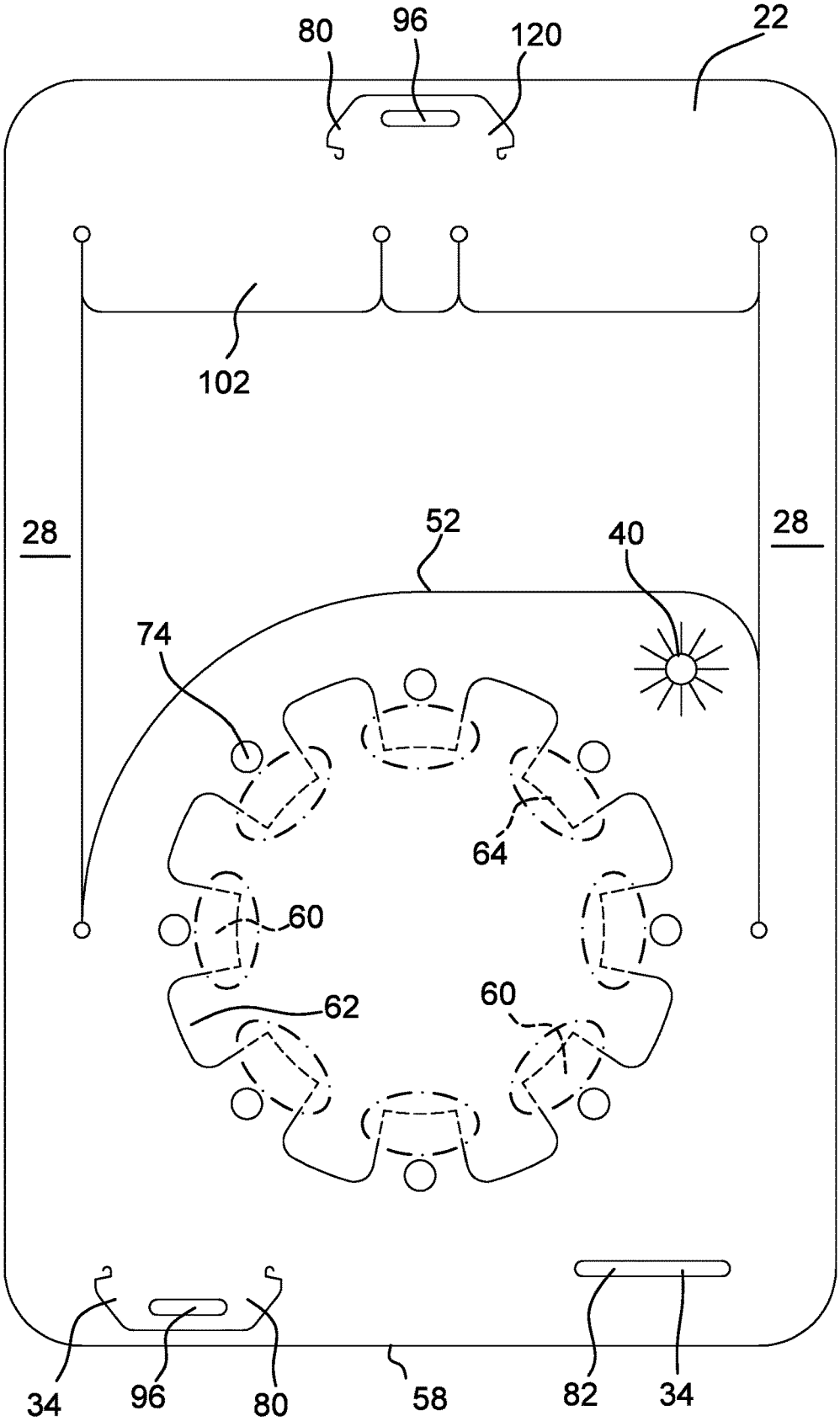
FIG. 32 is a top plan view of a fourth alternative embodiment of the single cup carrier of FIGS. 1-8 and 29-31, in which the shape of flaps of the cup-holding portion may be modified in FIGS. 1-8 and 29-31 (and the bottom view may be a mirror image of the top plan view).

FIG. 31 is a top plan view of an alternative embodiment of the single cup carrier 20*a* of FIGS. 1-8, 29, and 30 that demonstrates by the broken lines and boundary lines that the shape of the recesses 62 surrounding the cup-holding flaps 60 of the cup-holding aperture 36 may be modified to have any suitable shape. Similarly, FIG. 32 is a top plan view of an alternative embodiment of the single cup carrier 20*a* of FIGS. 1-8 and 29-31 that demonstrates by the broken lines and boundary lines that the shape of the cup-holding flaps 60 of the cup-holding aperture 36 may be modified to have any suitable shape. In particular, the sizes and/or shapes of the cup-holding flaps 60 and/or the aperture recesses 62 may be optimized to retain particular ranges of sizes and/or tapers of cups. More particularly, a single size and shape of the cup-holding flaps 60 and the aperture recesses 62 may be suitable for holding small, medium, and large cups of the same or different taper. However, different sheets of cup carriers 20 may have different the cup-holding apertures 36 that are optimized for different particular cup sizes with different particular tapers. Conventional standard cup volumes include 12, 16, 20, 24, 32, and 64 ounces, but cup volumes may be bigger or smaller. These standard cup volumes tend to have standard bottom or top diameters and standard tapers. The sizes and/or shapes of the cup-holding flaps 60 and/or the aperture recesses 62 may also be configured or optimized to hold the cups 38 with sufficient tightness so that the cup-holding flaps 60 will not become loose and drop toward the bottom of the cup 38 when the cup carrier 20 is not being held by the handle portion 22.

Each cup-holding portion 26 may also include one or more fold holes 74 that are positioned generally between neighboring aperture recesses 62 that may assist with bending the cup-holding flaps 60 with respect to the base portion 24. In some embodiments, the cup-holding portion has only one fold hole 74 between neighboring aperture recesses 62; however, two or more fold holes 74 between neighboring aperture recesses 62 could be employed.

The fold holes 74 may all have the same size, or they may have different sizes. Generally, the fold holes 74 may be configured to be smaller when their numbers are increased. Also, the fold holes may have a major fold-dimension (such as diameter) that is less than half of the distance between neighboring recess bottoms 66. The fold holes 74 may all be the same size, or they may be of different sizes. The number of fold holes 74 and the size(s) and shape(s) of the cup-holding flaps 60 may be configured so that the cup-holding flaps 60 bend easily but remain sturdy enough to engage the cup 38 in a manner such that the base portion 24 experiences minimal deformation effects due to the bending.

Accordingly, the fold holes 74 may be equally spaced between neighboring aperture recesses 62, they may be asymmetrically spaced between neighboring aperture recesses 62, or the fold holes 74 may be distributed in an assortment of equally spaced and nonequally spaced positions. The fold holes 74 may be positioned to be closer to the recess bottoms 66 of neighboring aperture recesses 62 than they are to the flap tops 64 of neighboring cup-holding flaps 60. In some embodiments, some or all of the fold holes 74 may be substantially aligned, or at least partly aligned, between the recess bottoms 66 of neighboring aperture recesses 62.

The fold holes 74 are shown as being generally circular; however, they may have a different shape. The fold holes 74 may be slot like, rectangular, square, elliptical, oval, any shape with curvature between transverse segments, or any other suitable shape. The fold holes 74 may all have the same shape, or they may have different shapes.

The base fasteners 34 may also be formed within the base portion 24 can also be configured in a variety of shapes, sizes, and types that mate with other base fasteners 34. Typically, the mated base fasteners 34 will have different shapes; however, the mated base fasteners 34 may have the same shape.

The mated base fasteners 34 may be attached to the base portions 24 of the sheet material, such as mated interlocking disks (snaps) or mated Velcro™ hooks and loops. Added features may additionally or alternatively include adhesives. Such adhesives may be single application adhesives that form permanent or semi-permanent bonds, or they may be multiple application adhesives that permit temporary bonding that can be relatively easy to release. The adhesiveness on the mated fasteners 34 can be the same or different. In some embodiments, the adhesives may employ complementary compositions that bond with each other. In some embodiments, the adhesive areas on the base fasteners 34 may be covered by a protective covering, such as a film sheet that can be removed to activate or expose the adhesive just before the base fasteners 34 are connected to each other.

Alternatively or additionally, the mated base fasteners 34 may constitute features formed in the sheet material itself. These features may have any type of complementary shape and size. For example, these features may include mated zipper-locking ridges and troughs, such as commonly used for re-sealable bags, where one base fastener 34 would include one or more ridges and the mated base fastener 34 would include one or more troughs.

Figure 33:
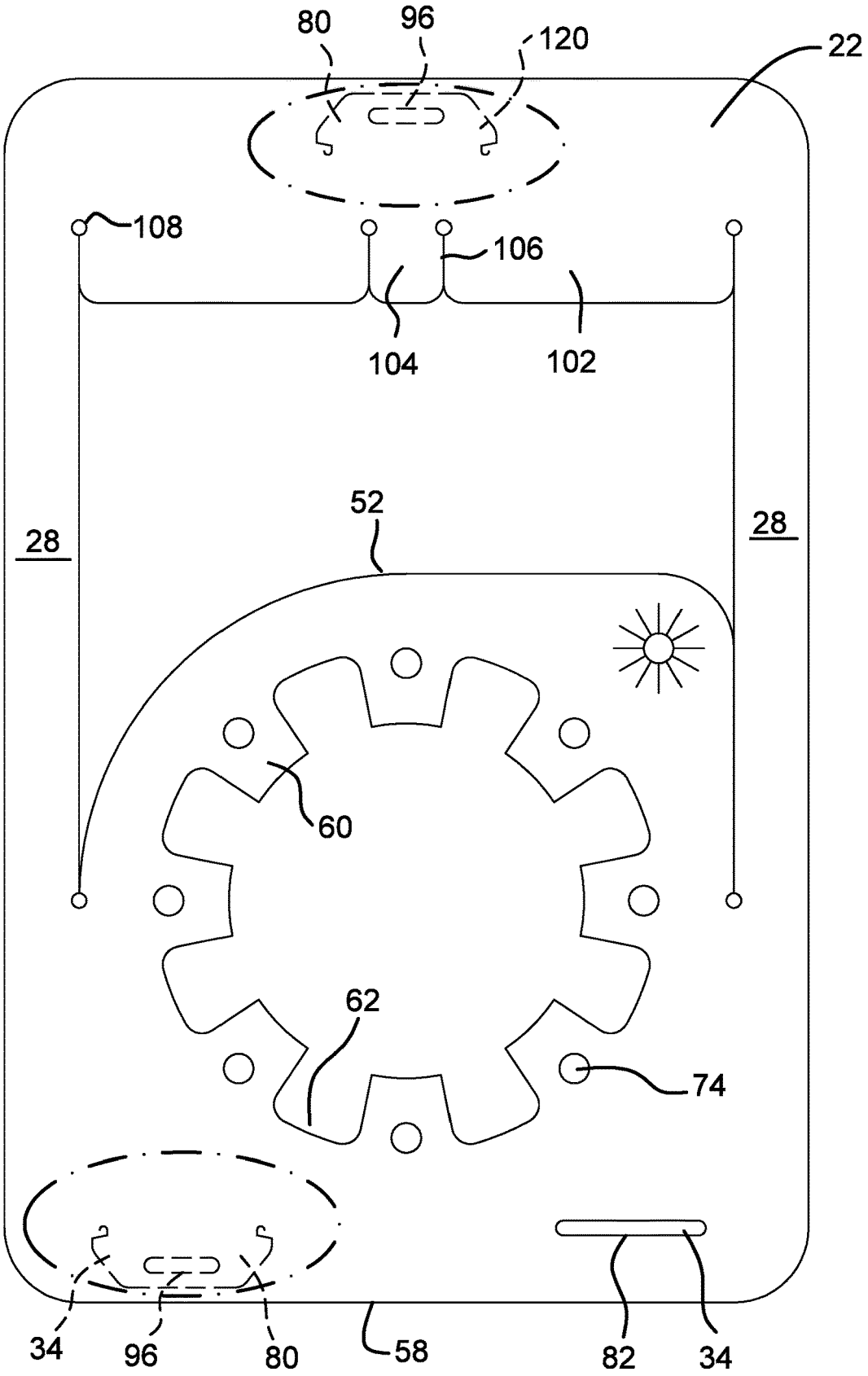
FIG. 33 is a top plan view of a fifth alternative embodiment of the single cup carrier of FIGS. 1-8 and 29-32, in which the shape of tabs may be modified in FIGS. 1-8 and 29-32 (and the bottom view may be a mirror image of the top plan view).

In another example, the base fasteners 34 may include mated tabs 80 and slits or slots 82, such as shown in the figures. The slots 82 may be elliptical or oval in shape. The tabs 80 may have a tab top 84 having a tab-top length 86 that is shorter than a tab flare length (or tab base length) 88 between tab-flare ends (or tab base ends) 90. One will appreciate that these tabs 80 and slots 82 may be configured in a variety of shapes and sizes. The base fasteners 34 may have a fastener length 92 that may be shorter than half the sheet width 42 or shorter than half the cup-holding portion width 50. The base fasteners 34 may have a fastener length 92 that may be shorter than a third of the sheet width 42 or shorter than a third of the cup-holding portion width 50. The slots 82 may be less than 5 mm wide or less than 3 mm wide. The tabs 80 may be less than 50 mm wide, less than 40 mm wide, less than 30 mm wide, or less than 20 mm wide. FIG. 33 is a top plan view of an alternative embodiment of the single cup carrier 20*a* of FIGS. 1-8 and 29-32, in which the shape of tabs 80 may be modified. In particular, the broken lines and boundary lines suggest that the tabs 80 may have any suitable shape.

The tabs 80 may be configured to include one or more tab voids 96. The tab voids 96 may be of any shape. The tab voids 96 may be useful for handling the tabs 80 especially between two fingers in the context of connecting two base portions 24 or connecting to handle portions 22 as later described.

One will appreciate that formation of tabs 80 consequently creates an opening in the sheet material at the tab top 84. Accordingly, identical tabs 80 could form mated base pairs, particularly if the tabs 80 are configured so that the tab tops 84 are wider than the bottom of the tabs 80. In such a configuration, the tab openings at the bottom of the tabs 80 would catch the wider tab tops 84. One will also appreciate that the tabs 80 need not have any flare at all. For example, the tabs 80 may be substantially rectangular or have any other shape, especially any shape including one or more undercuts (or notches) 94 that may be beneath the base of the shape.

The base fasteners 34 may be positioned to match the locations of the base fasteners 34 on other cup holder sheets. The base fasteners 34 may be equally spaced with respect to side edges 56 of the cup holder sheets and/or with respect to each other. Equal spacing of the base fasteners 34 from the sheet edges 56 would permit interchangeability between the front and back sides of the cup holder sheets. The base fasteners 34 may be located generally between the cup-holding aperture 36 and a bottom edge 58 of the cup holder sheets. In some embodiments, the base fasteners may be positioned closer to the bottom edge 58 than to the cup-holding aperture 36; however, in other embodiments, the base fasteners may be positioned closer to the cup-holding aperture 36 than to the bottom edge 58.

Figure 9:
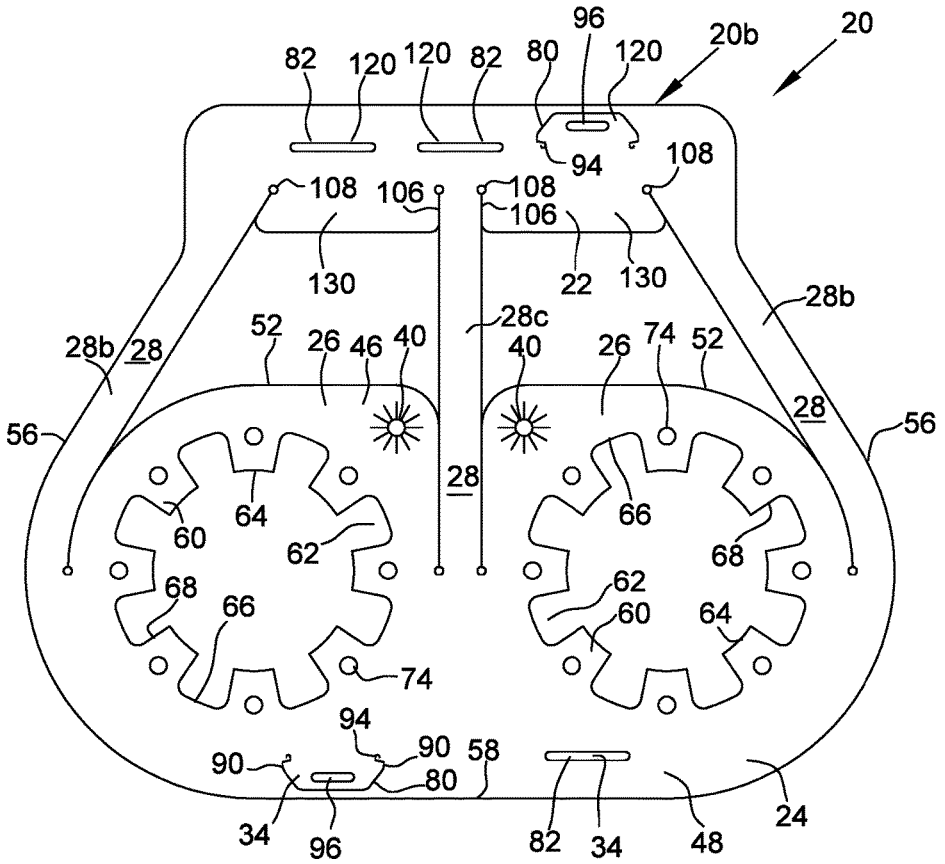
FIG. 9 is a top plan view showing an embodiment of a double cup carrier including a handle portion and a base portion 24 that has two cup-holding portions 26 (and the bottom view may be a mirror image of the top plan view).

The handle portion 22 may have substantially the same width as the sheet width 42 (such as shown in FIG. 1), but the widths may be different (such as shown in FIG. 9). Similarly, the handle portion 22 may have substantially the same width as that of the base portion (such as shown in FIG. 1), but the widths may be different (such as shown in FIG. 9). Typically, the handle portion with have a length 100 that is shorter than a length 102 of the base portion 24.

The handle portion 22 may also be configured to provide one or more handle folds 102 that may increase the sturdiness or grip comfort of the resulting handles formed by the handle portion 22. The handle folds 102 may be positioned between the straps 28. In one example, a single handle fold 102 may extend the entire distance between the straps 28 and a width that substantially matches the width 50 of the cup-holding portion 26. In another example, the handle portion 22 has multiple handle folds 102 of equal widths. In yet another example, the handle portion 22 has multiple handle folds 102 of different widths. In still another example, the handle portion 22 has at least two handle folds 102 of substantially the same width that may be separated by a substantially narrower handle nub 104.

The handle folds 102 may be separated by (or defined by) one or more fold slits (or cutting lines) 106. In some examples, the fold slits 106 may be wider than a mere crack such that the handle folds are spaced apart. The fold slits 106 may terminate in tear stops 108 that may prevent weak spots that could promote undesired propagation, such as ripping or tearing, of the fold slits 106. In one example, the tear stops 108 have a circular shape; however, any suitable shape could be employed. Some suitable shapes for the tear stops 108 may include some element of curvature.

Fold lengths 110 of the fold slits 106 from the tear stops 108 to a bottom edge 112 of the handle portion 22 may partly define the depth and shape of the handle folds 102. In one example, the fold lengths 110 of the fold slits 106 are substantially the same so that handle depths 114 are the same on both sides of the handle folds 102. However, the fold lengths 110 closest to the sheet side edges 56 may be shorter than the ones closest to the middle or the fold lengths 110 closest to the middle may be shorter than the ones closest to sheet side edges 56 to provide a desirable handle shape. Similarly, the bottom edge 112 of the handle portion may be contoured to provide a more comfortable gripping edge. Moreover, the handle portion depth 114 can be sized to facilitate comfortable gripping. The handle portion length 100 or the handle depth 114 can be sized to provide adequate space for branding or logos.

The handle portion 22 may also provide one or more handle fasteners 120 that may be configured to have the same features or variations as those described for the base fasteners 34. Thus, for convenience, these features of the handle fasteners 120 have been labeled with the same reference numbers that were used for the equivalent features of the base fasteners 34. For example, in FIGS. 1, 5, and 7, a single handle fastener 120 is depicted as a centrally located tab 80. FIG. 29, which is a top plan view of an alternative embodiment of the single cup carrier 20*a* of FIGS. 1-8, depicts a single handle fastener 120 as a slot 82. Such a tab 80 or a slot 82 may be identical in shape and proportions to those of the base fasteners 34. Alternatively, the features, shapes, and/or sizes of the handle fasteners 120 may be intentionally different from those of the base fasteners 34 to avoid possible confusion that could result in a customer trying to mate the handle fasteners 120 with the base fasteners 34. As previously discussed, the broken lines and boundary lines of FIG. 33 depict that the tabs 80 may have any suitable shape. The relative spacing and positioning of the handle fasteners 120 with respect to each other and the side edges 56 may be similar to those of the base fasteners 34, or they may be different.

Figure 10:
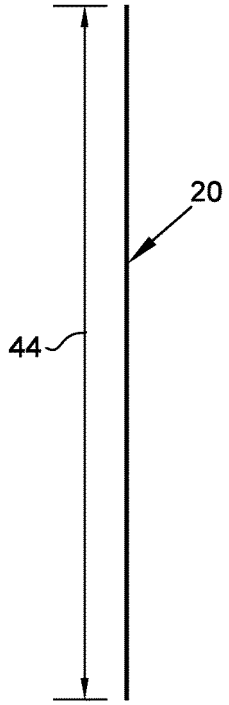
FIG. 10 is a right side elevation view of the double cup carrier of FIG. 9 (and the left side elevation view may be an identical image of the right side elevation view).
Figure 11:
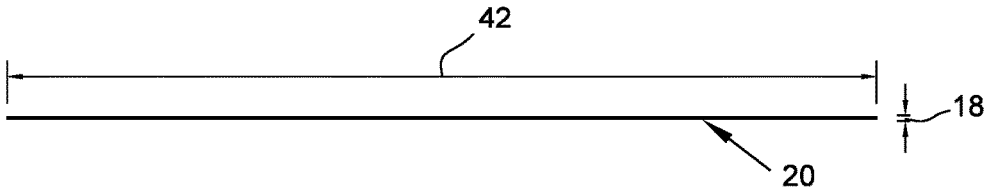
FIG. 11 is a front elevation view of the double cup carrier of FIG. 9 (and the rear elevation view may be an identical image of the front elevation view).
Figure 12:
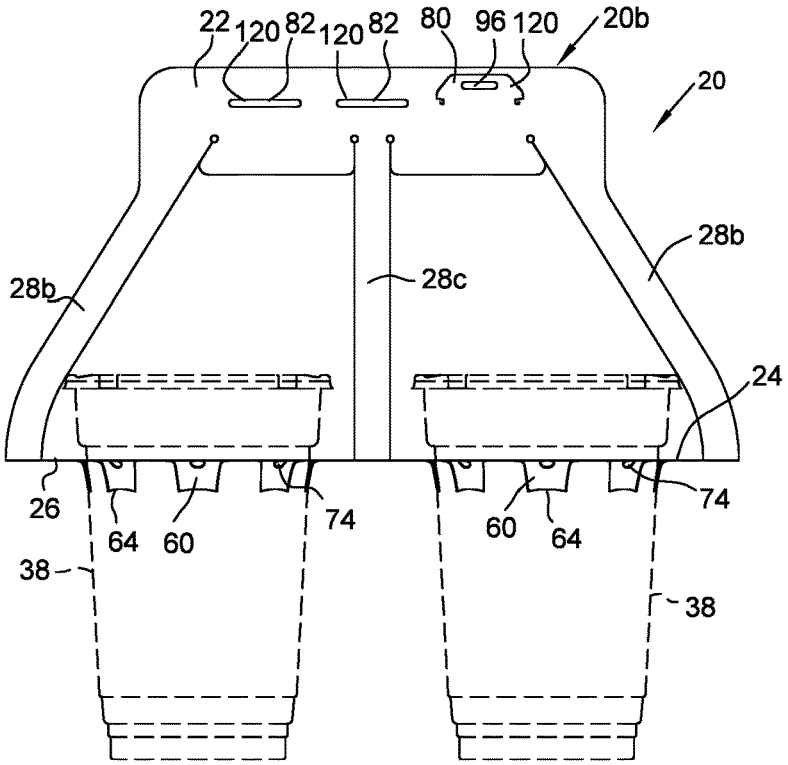
FIG. 12 is a front elevation view of the double cup carrier of FIG. 9, shown in a folded arrangement with the handle portion arranged in a transverse direction to the base portion.
Figure 13:
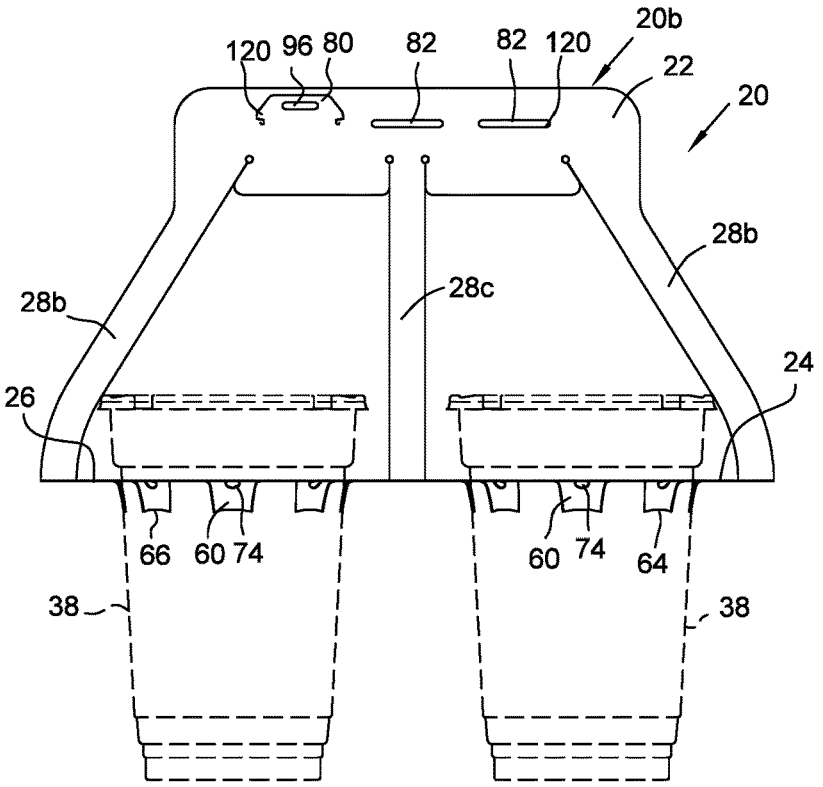
FIG. 13 is a rear elevation view of the double cup carrier of FIG. 9, shown in a folded arrangement with the handle portion arranged in a transverse direction to the base portion.
Figure 14:
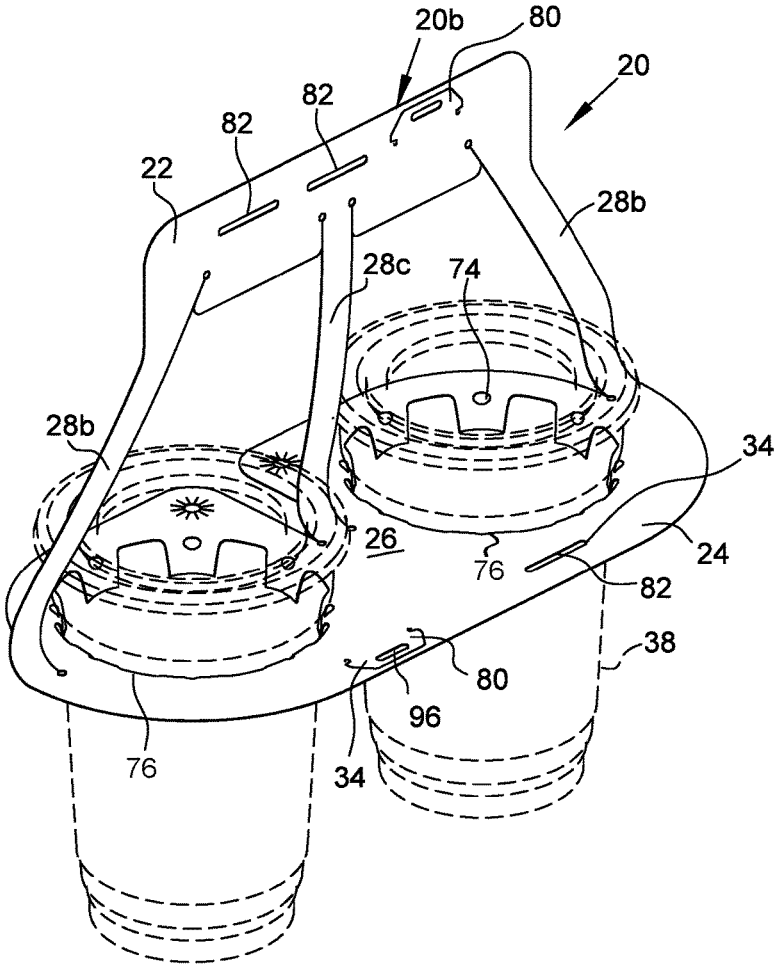
FIG. 14 is an isometric view of the double cup carrier of FIG. 9, shown in a folded arrangement with the handle portion arranged in a transverse direction to the base portion.
Figure 15:
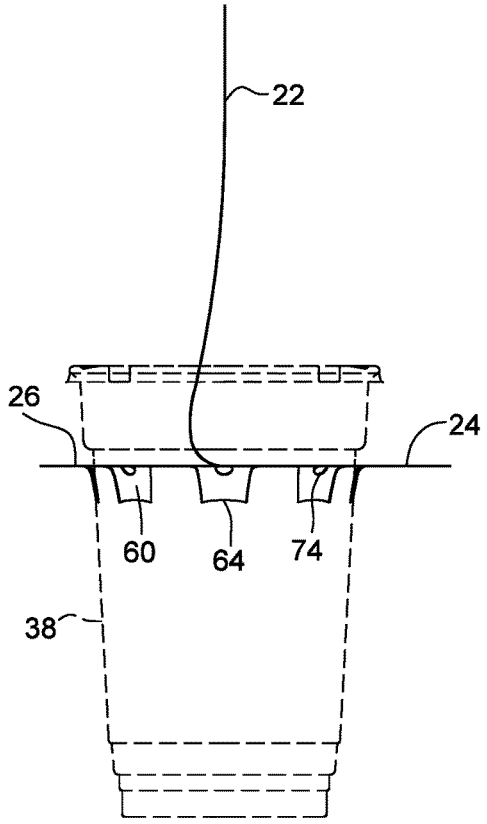
FIG. 15 is a right side elevation view of the double cup carrier of FIG. 9, shown in a folded arrangement with the handle portion arranged in a transverse direction to the base portion (and the left side elevation view of the folded arrangement may be an identical image of the right side elevation view of the folded arrangement).
Figure 16:
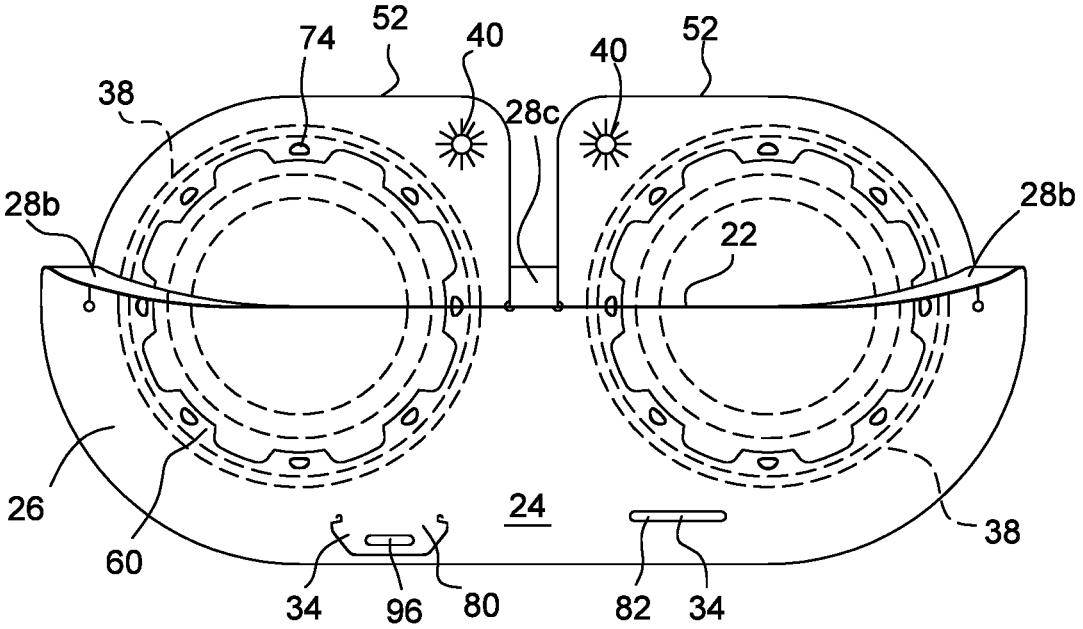
FIG. 16 is top plan view of the double cup carrier of FIG. 9, shown in a folded arrangement with the handle portion arranged in a transverse direction to the base portion.
Figure 17:
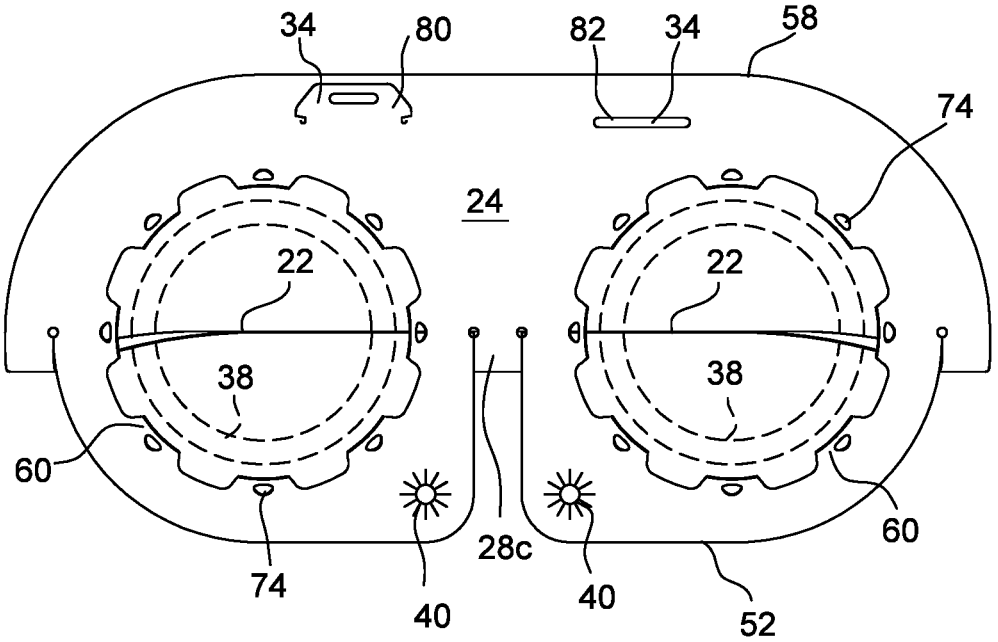
FIG. 17 is bottom view of the double cup carrier of FIG. 9, shown in a folded arrangement with the handle portion arranged in a transverse direction to the base portion.

FIG. 9 is a top plan view showing an embodiment of a double cup carrier 20*b* including a handle portion 22 and a base portion 24 that has two cup-holding portions 26 (and the bottom view may be a mirror image of the top plan view); FIG. 10 is a right side elevation view of the double cup carrier 20*b* of FIG. 9 (and the left side elevation view is an identical image of the right side elevation view); and FIG. 11 is a front elevation view of the double cup carrier 20*b* of FIG. 9 (and the rear elevation view is an identical image of the front elevation view). FIG. 12 is a front elevation view of the double cup carrier 20*b* of FIG. 9, shown in a folded arrangement with the handle portion 22 arranged in a transverse direction to the base portion 24; FIG. 13 is a rear elevation view of the double cup carrier 20*b* of FIG. 9, shown in a folded arrangement with the handle portion 22 arranged in a transverse direction to the base portion 24; FIG. 14 is an isometric view of the double cup carrier 20*b* of FIG. 9, shown in a folded arrangement with the handle portion 22 arranged in a transverse direction to the base portion 24; FIG. 15 is a right side elevation view of the double cup carrier 20*b* of FIG. 9, shown in a folded arrangement with the handle portion 22 arranged in a transverse direction to the base portion 24 (and the left side elevation view of the folded arrangement is an identical image of the right side elevation view of the folded arrangement); FIG. 16 is top plan view of the double cup carrier 20*b* of FIG. 9, shown in a folded arrangement with the handle portion 22 arranged in a transverse direction to the base portion 24; and FIG. 17 is bottom view of the double cup carrier 20*b* of FIG. 9, shown in a folded arrangement with the handle portion 22 arranged in a transverse direction to the base portion 24.

With reference to FIGS. 9-17, the double cup carrier 20*b* may exhibit many substantially identical features and variations as those shown or discussed with respect to the single cup carrier 20*a*. In this regard, similar features in FIGS. 9-17 may be labeled with the same reference numbers as those in FIGS. 1-8. One with also appreciate that many or all of the variations previously discussed with respect to FIGS. 1-8 may be applied to the embodiments depicted in FIGS. 9-17.

One potential significant difference may be the dimensions of the sheets of material for the double cup carrier 20*b*. For example, the sheet width 42 for the double cup carrier 20*b* may be longer than the sheet length 44. The sheet length may be a function of the selected standard cup volume. Moreover, in some embodiments, the sheet width 42 for the double cup carrier 20*b* may be about twice as long the sheet width 42 for the single cup carriers 20*a*. This size relationship may provide certain manufacturing advantages such as if shared equipment is used for stamping or cutting out the various apertures, and each material sheet used for a double cup carrier 20*b* could alternatively be used to provide two single cup carriers 20*a*.

In some embodiments, the double cup carrier 20*b* may have a handle portion 22 that is narrower than the sheet width 42. The handle portion 22 of the double cup carrier 20*b* may be wider than or equal to the width of the handle portion 22 of the single cup carrier 20*a*. Moreover, the handle portion 22 of the double cup carrier 20*b* may be wider than the cup-holding portion width 50 but narrower than the base portion 24.

Because the handle portion 22 may be narrower than the base portion 24, the straps 28, such as straps 28*b*, may be angled inward from the base portion 24 to the handle portion 22. Angle ranges may be from about 10 to 90 degrees (or outside this range), largely depending on the strap length 32 and the standard volume of the cup. As a consequence of these angles, the straps 28*b* may be longer than the straps 28*a*. In general, smaller angles may provide greater stability than larger angles.

Figure 34:
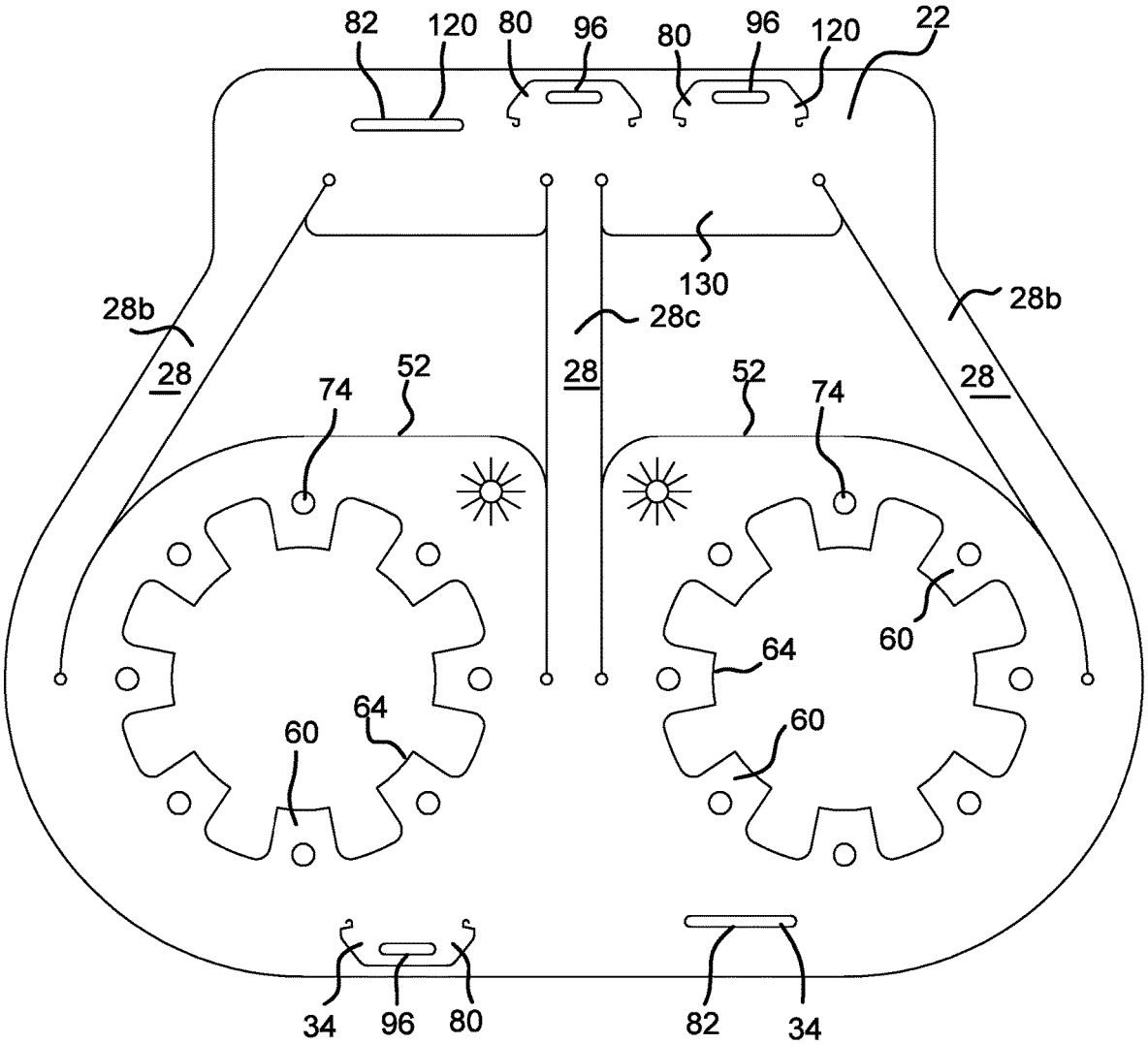
FIG. 34 is a top plan view of a first alternative embodiment of the double cup carrier of FIGS. 9-17, in which a slot is shown that can be substituted for a tab in FIGS. 9-17 (and the bottom view may be a mirror image of the top plan view).
Figure 35:
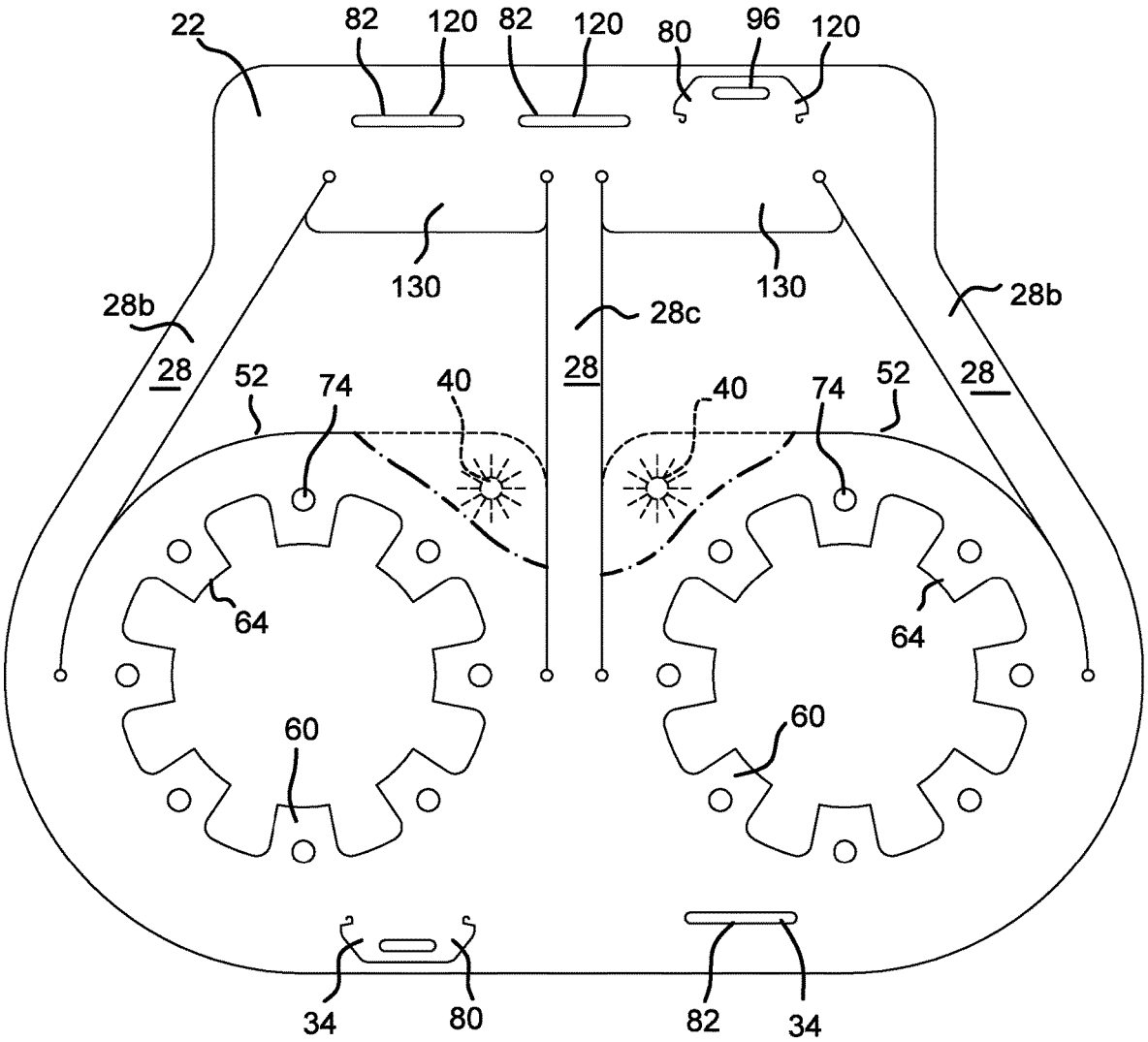
FIG. 35 is a top plan view of a second alternative embodiment of the double cup carrier of FIGS. 9-17 and 34, in which the shape of the cup-holding portion may be modified to exclude one or both straw holders in FIGS. 9-17 and 34 (and the bottom view may be a mirror image of the top plan view).

The handle portion 22 of the double cup carrier 20*b* may be divided in to two handle portion areas 130 that may be partly partitioned by a central strap 28*c* that extends toward the middle of the base portion 24. The central strap 28*c* may also partly partition the base portion 24 into the two cup-holding portions 26 that each have a cup-holding aperture 36. FIG. 35 is a top plan view of an alternative embodiment of the double cup carrier 20*b* of FIGS. 9-17 and 34, in which the shape of the free edges 52 of the free regions 46 of the cup-holding portions 50 of the base portion 24 may be configured to exclude the auxiliary apertures 40 as shown by the broken lines and boundary lines.

Figure 37:
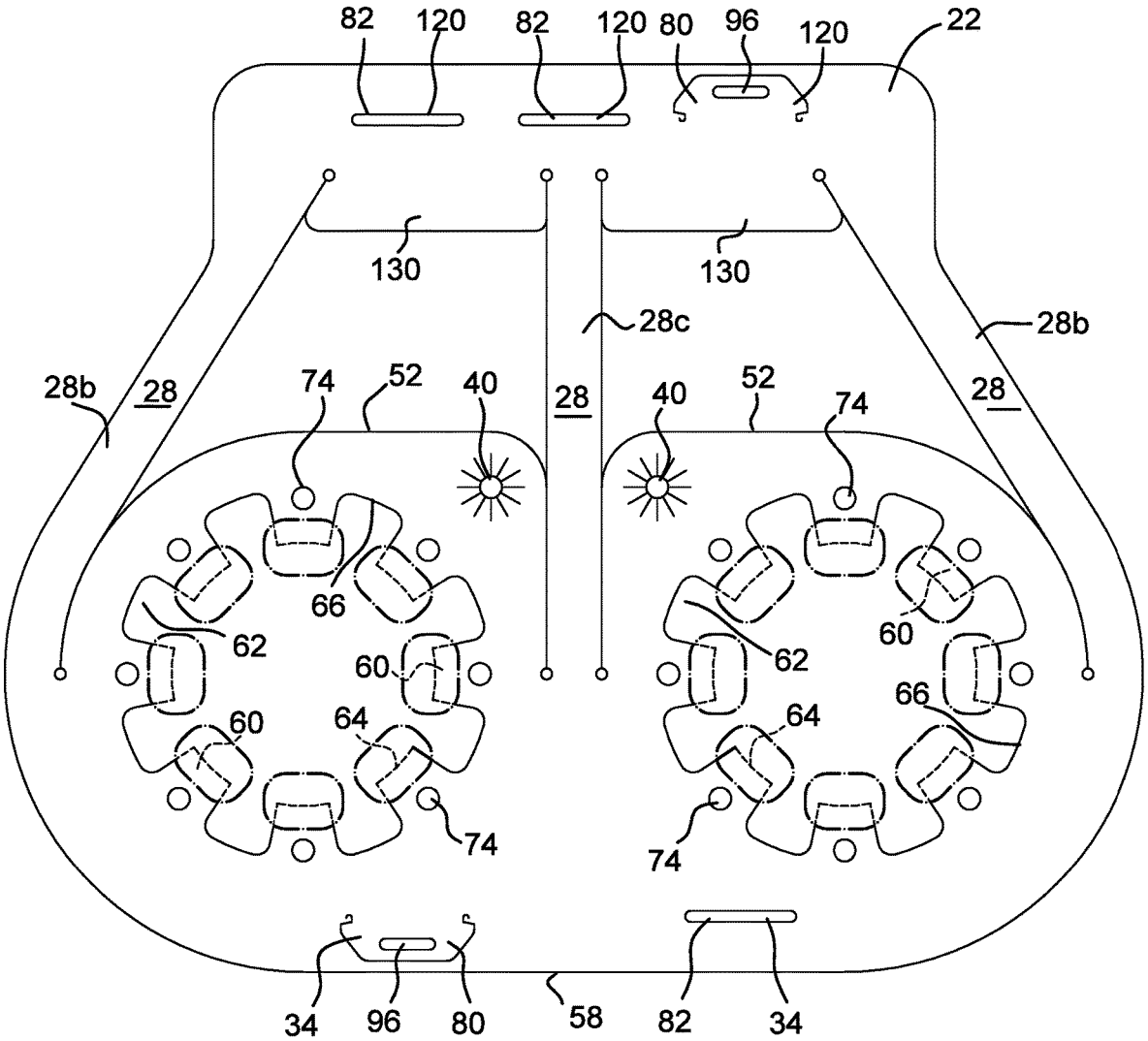
FIG. 37 is a top plan view of a fourth alternative embodiment of the double cup carrier of FIGS. 9-17 and 34-36, in which the shape of flaps of the cup-holding portion may be modified in FIGS. 9-17 and 34-36 (and the bottom view may be a mirror image of the top plan view).
Figure 38:
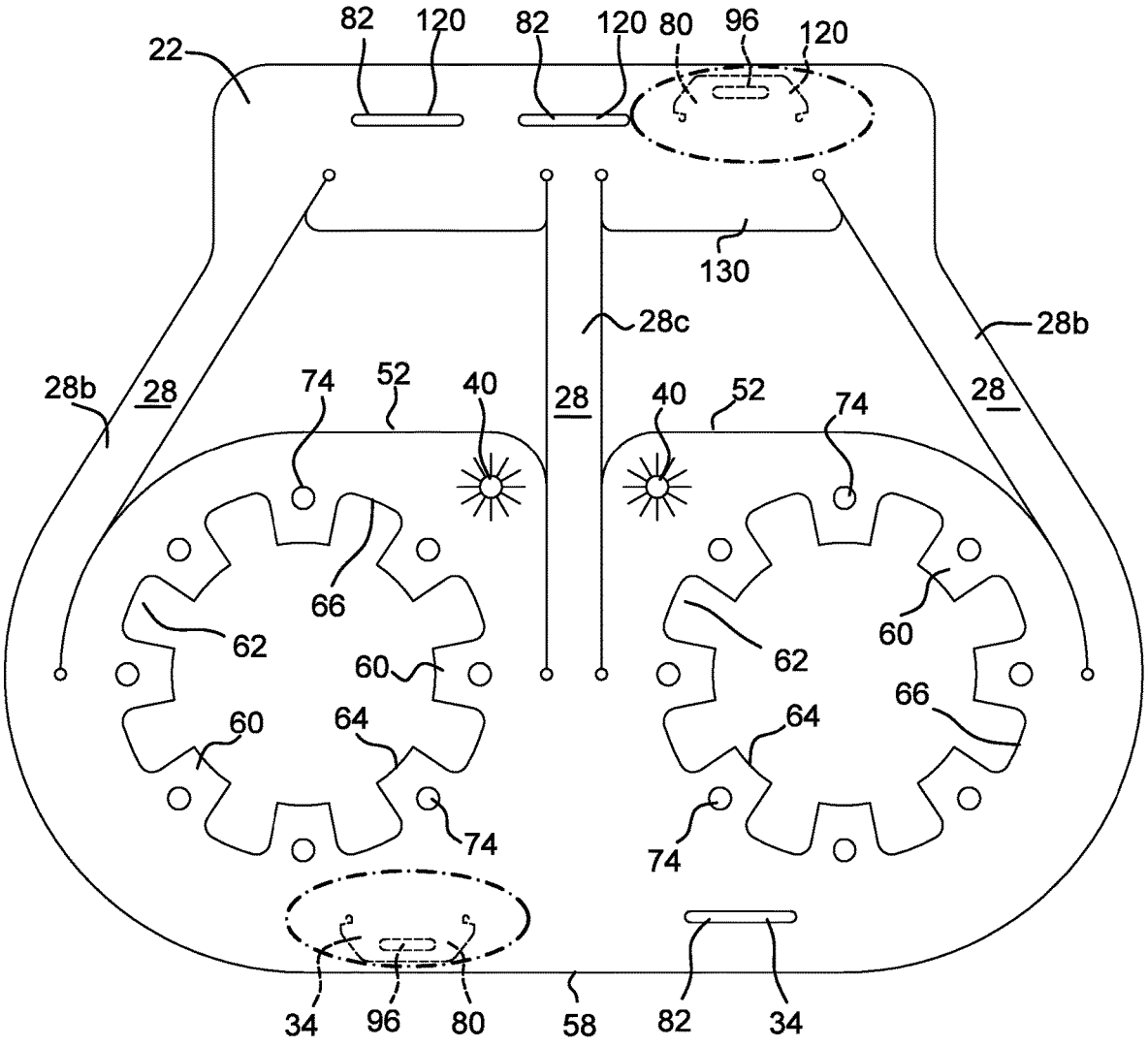
FIG. 38 is a top plan view of a fifth alternative embodiment of the double cup carrier of FIGS. 9-17 and 34-37, in which the shape of one or both tabs may be modified in FIGS. 9-17 and 34-37 (and the bottom view may be a mirror image of the top plan view).

The handle portion 22 of the double cup carrier 20*b* may include more handle fasteners 120 than provided in the handle portion 22 of the single cup carrier 20*a*. For example, the double cup carrier 20*b* may include two or more, or three or more, handle fasteners 120. In particular, each handle portion area 130 may have one handle fastener 120, and an additional handle fastener 120 may be positioned centrally, such as centrally aligned with respect to the central strap 28*c*. One will appreciate that the number of handle fasteners 120 may be different and that they may be positioned symmetrically or asymmetrically. These handle fasteners 120 can all be of the same type, they may all be of different types, or two may be of the same type. For example, FIGS. 9 and 12-24 depict a handle portion 22 having two slots 82 and one tab 80, and FIG. 34 depicts a handle portion 22 having two tabs 80 and one slot 82. FIG. 38 is a top plan view of an alternative embodiment of the double cup carrier 20*b* of FIGS. 9-17 and 34-37, in which the shape of tabs 80 may be modified. In particular, the broken lines and boundary lines suggest that the tabs 80 may have any suitable shape. The handle fasteners 120 may be configured to mate with the handle fastener(s) 120 of the single cup carrier 20*a* and/or some or all of opposing handle fasteners 120 on a second double cup carrier 20*b*.

Similarly, the base portion 24 of the double cup carrier 20*b* may include a greater than or equal number of handle fasteners 120 than provided in the handle portion 22 of the single cup carrier 20*a*. For example, the double cup carrier 20*b* may include two or more, or three or more, base fasteners 34. In particular, each cup-holding portion 26 may have one handle fastener 120, and an additional base fastener 34 may be positioned centrally, such as centrally aligned with respect to the central strap 28*c*. One will appreciate that the number of base fasteners 34 may be different and that they may be positioned symmetrically or asymmetrically. These base fasteners 34 can all be of the same type, they may all be of different types, or two may be of the same type. These base fasteners 34 may be configured to mate with the base fasteners 34 of the single cup carrier 20*a* and/or some or all of opposing base fasteners 34 on a second double cup carrier 20*b*.

Figure 36:
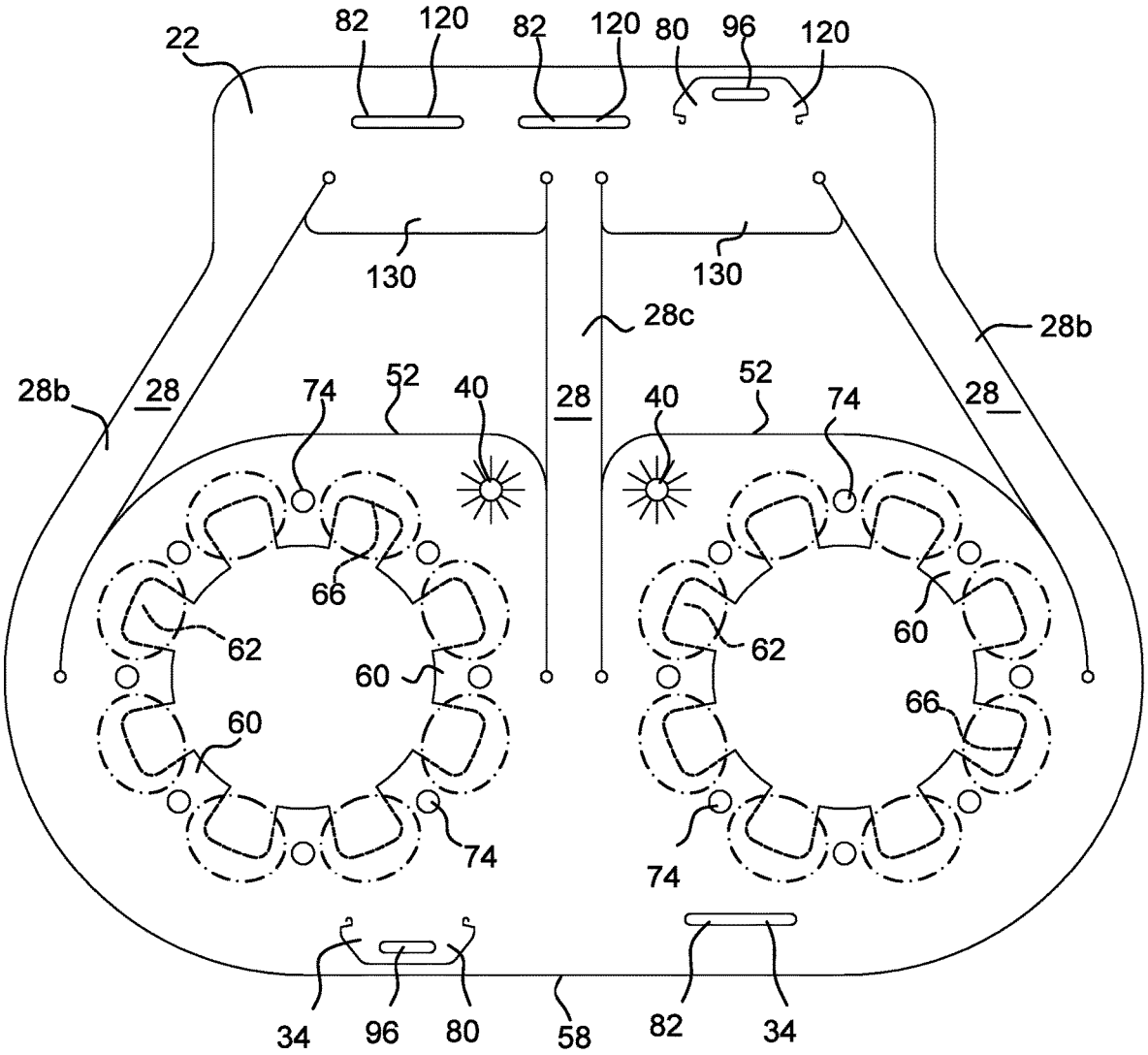
FIG. 36 is a top plan view of a third alternative embodiment of the double cup carrier of FIGS. 9-17, 34, and 35 in which the shape of recesses surrounding flaps of the cup-holding portion may be modified in FIGS. 9-17, 34, and 35 (and the bottom view may be a mirror image of the top plan view).

FIG. 36 is a top plan view of an alternative embodiment of the double cup carrier 20*b* of FIGS. 9-17, 34, and 35 that demonstrates by the broken lines and boundary lines that the shape of the recesses 62 surrounding the cup-holding flaps 60 of the cup-holding aperture 36 may be modified to have any suitable shape. Similarly, FIG. 37 is a top plan view of an alternative embodiment of the double cup carrier of FIGS. 9-17, and 34-36 that demonstrates by the broken lines and boundary lines that the shape of the cup-holding flaps 60 of the cup-holding aperture 36 may be modified to have any suitable shape.

Figure 18:
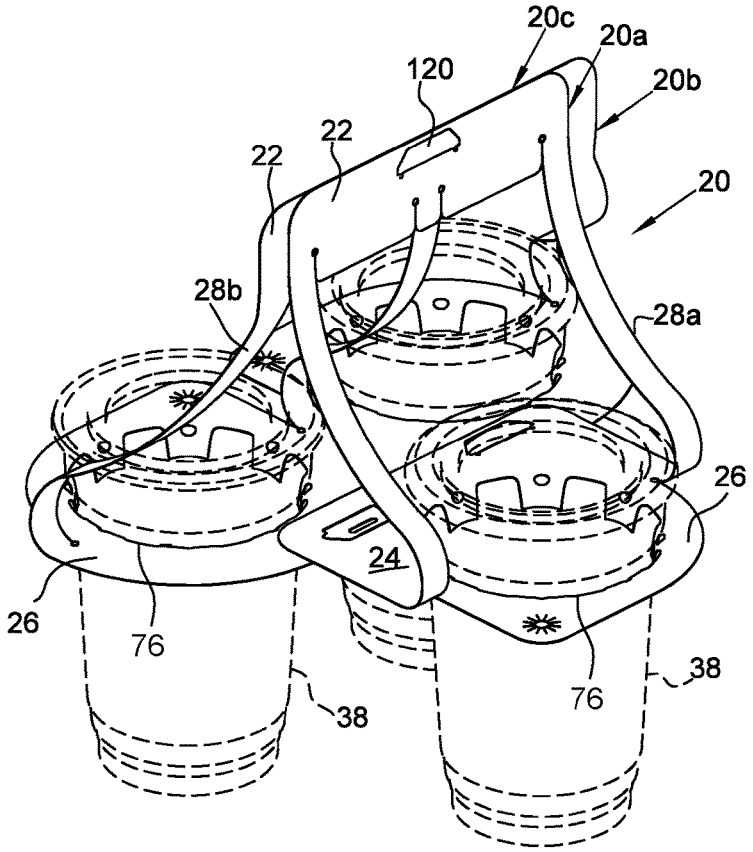
FIG. 18 is an isometric view showing an embodiment of a triple cup carrier, shown in a folded arrangement with a handle portion arranged in a transverse direction to a cup-holding portion.
Figure 19:
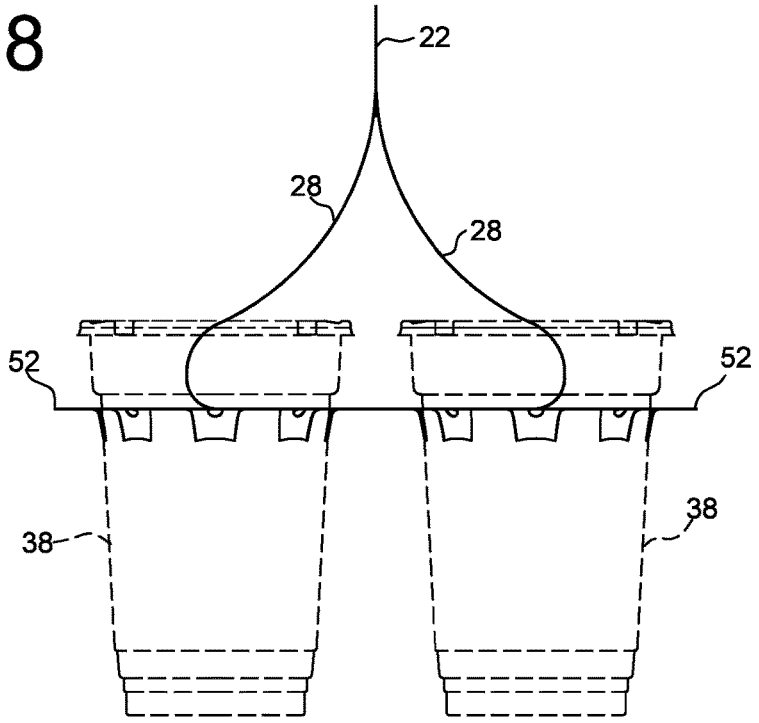
FIG. 19 is a right side elevation view of the triple cup carrier of FIG. 18, shown in a folded arrangement with the handle portion arranged in a transverse direction to the cup-holding portion (and the left side elevation view of the folded arrangement may be an identical image of the right side elevation view of the folded arrangement).
Figure 20:
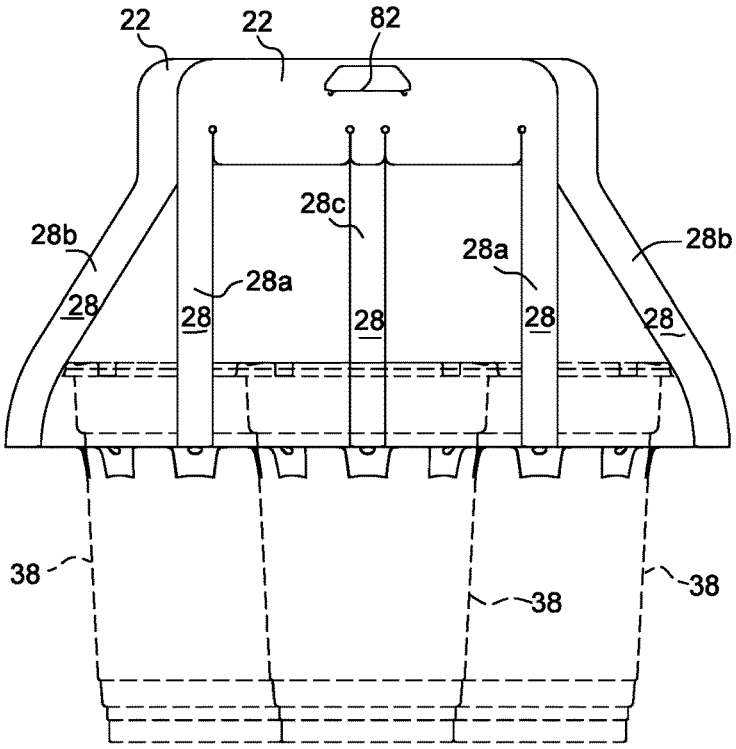
FIG. 20 is a front elevation view of the triple cup carrier of FIG. 18, shown in a folded arrangement with the handle portion arranged in a transverse direction to the cup-holding portion.
Figure 21:
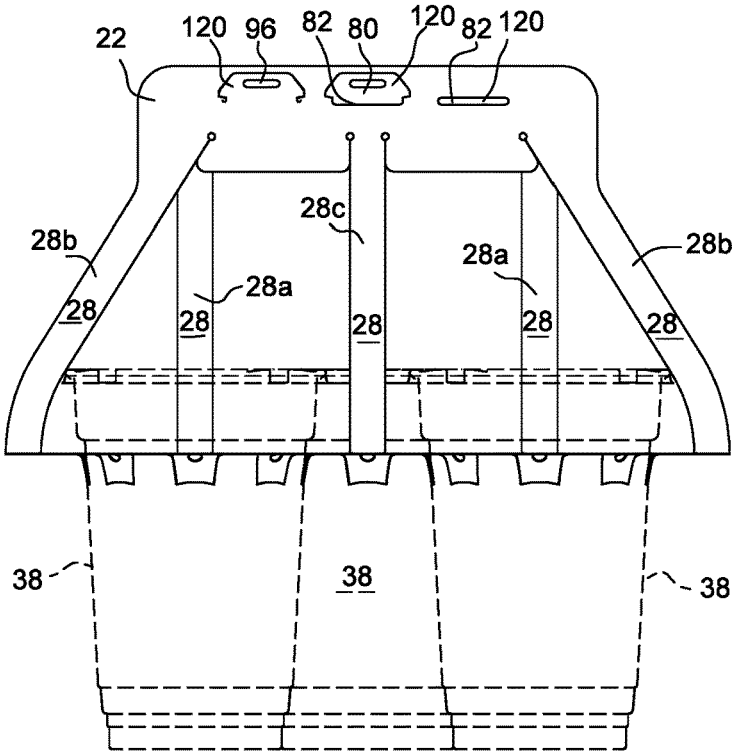
FIG. 21 is a rear elevation view of the triple cup carrier of FIG. 18, shown in a folded arrangement with the handle portion arranged in a transverse direction to the cup-holding portion.
Figure 22:
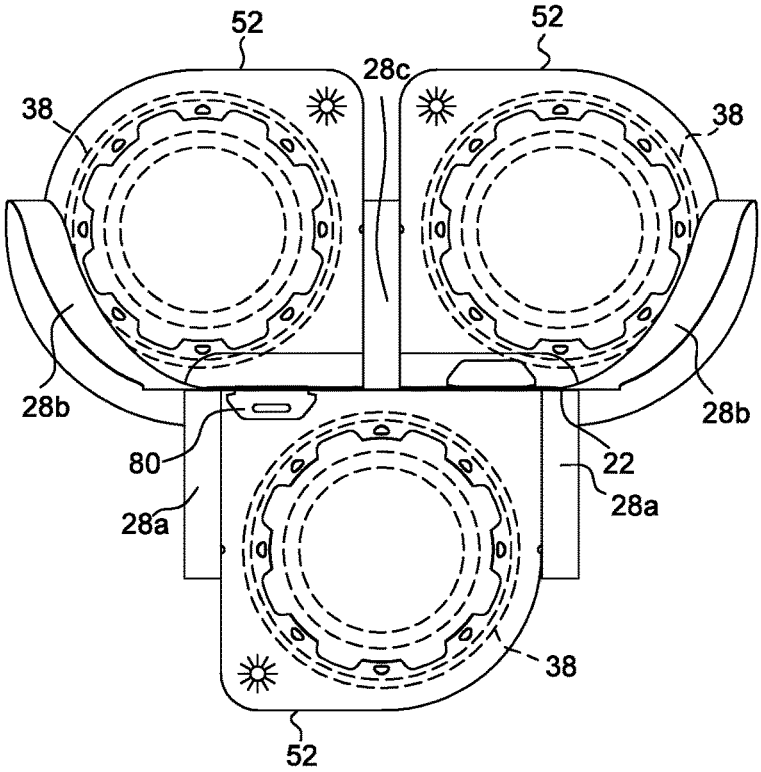
FIG. 22 is a top plan view of the triple cup carrier of FIG. 18, shown in a folded arrangement with the handle portion arranged in a transverse direction to the cup-holding portion.
Figure 23:
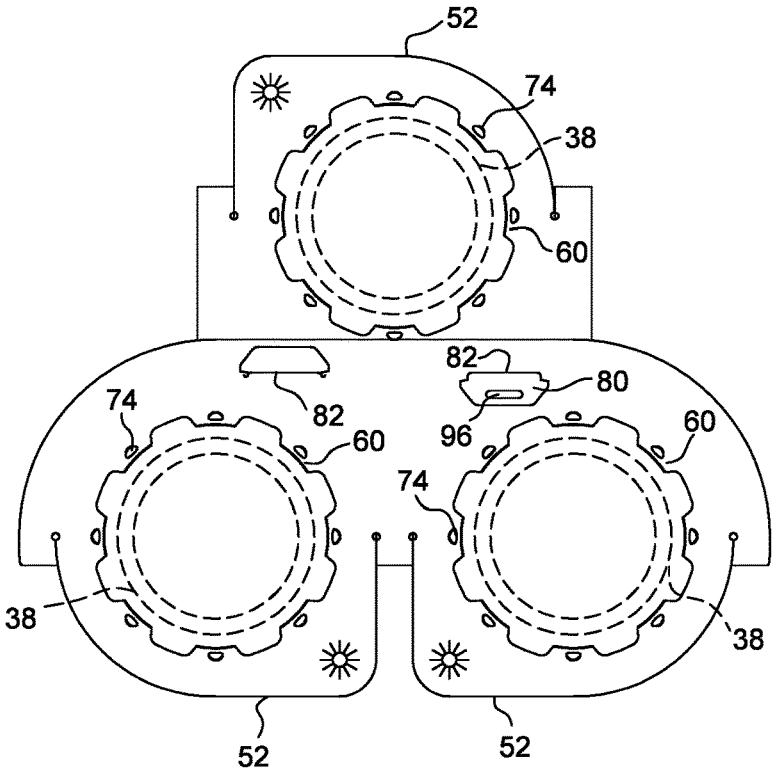
FIG. 23 is bottom view of the triple cup carrier of FIG. 18, shown in a folded arrangement with the handle portion arranged in a transverse direction to the cup-holding portion.

FIG. 18 is an isometric view showing an embodiment of a triple cup carrier 20*c*, shown in a folded arrangement with the handle portions 22 arranged in a transverse direction to the base portions 24 that include a total of three cup-holding portions 26; FIG. 19 is a right side elevation view of the triple cup carrier 20*c* of FIG. 18, shown in a folded arrangement with the handle portions 22 arranged in a transverse direction to the base portions 24 (and the left side elevation view of the folded arrangement may be an identical image of the right side elevation view of the folded arrangement); FIG. 20 is a front elevation view of the triple cup carrier 20*c* of FIG. 18, shown in a folded arrangement with the handle portions 22 arranged in a transverse direction to the base portions 24; FIG. 21 is a rear elevation view of the triple cup carrier 20*c* of FIG. 18, shown in a folded arrangement with the handle portions 22 arranged in a transverse direction to the base portions 24; FIG. 22 is a top plan view of the triple cup carrier 20*c* of FIG. 18, shown in a folded arrangement with the handle portions 22 arranged in a transverse direction to the base portions 24; and FIG. 23 is bottom view of the triple cup carrier 20*c* of FIG. 18, shown in a folded arrangement with the handle portions 22 arranged in a transverse direction to the base portions 24.

With reference to FIGS. 18-23, the single cup carrier 20*a* can be connected to the double cup carrier 20*b* to produce the triple cup carrier 20*c*, which has three-cup holding portions 26. Assembly of the triple cup carrier 20*c* may involve connecting the base fasteners 34 of the single cup carrier 20*a* to the mated base fasteners 34 of the double cup carrier 20*b*. For example, the tabs 80 can be inserted into the slots 82 until the notches 94 pass through the slots 82 and secure the tabs 80 in place. Similarly, the handle fastener(s) 120 of the single cup carrier 20*a* may be connected to the mated handle fastener(s) 120 of the double cup carrier 20*b*. Even though it might prove easier to start by connecting the base fasteners 34, one will appreciate that the handle fastener(s) 120 could be connected first.

Figure 24:
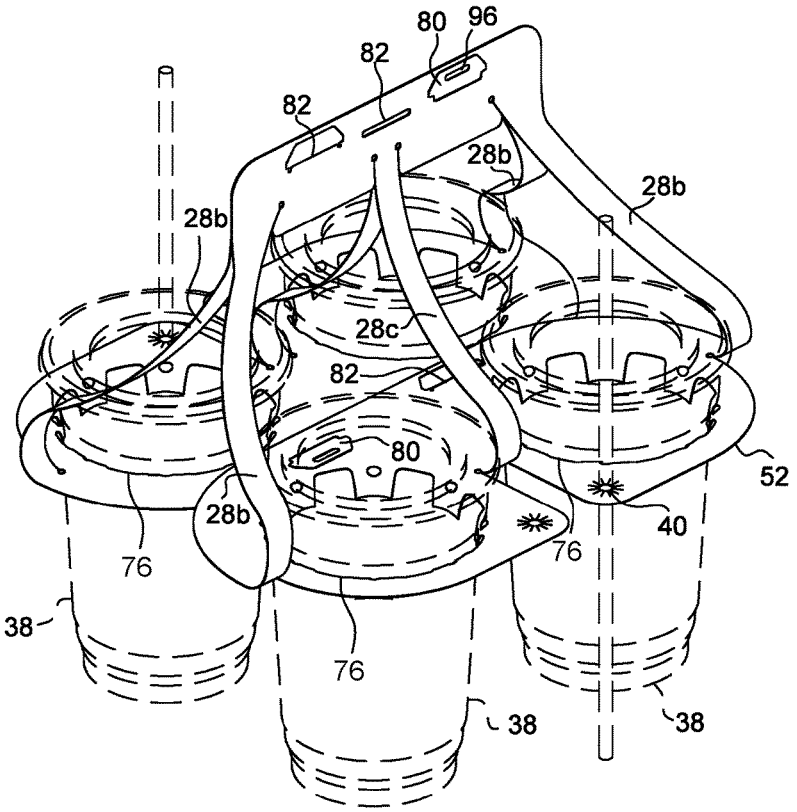
FIG. 24 is an isometric view showing an embodiment of a quadruple cup carrier, shown in a folded arrangement with a handle portion arranged in a transverse direction to a cup-holding portion.
Figure 25:
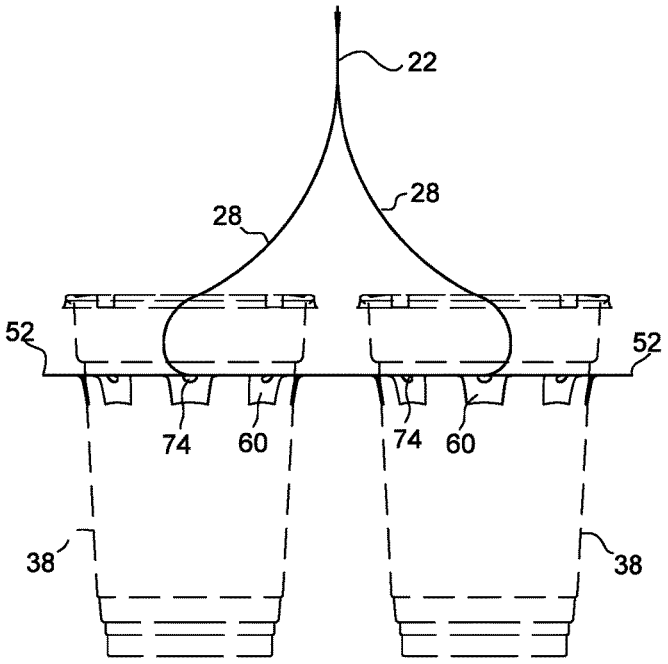
FIG. 25 is a right side elevation view of the quadruple cup carrier of FIG. 24, shown in a folded arrangement with a handle portion arranged in a transverse direction to a cup-holding portion (and the left side elevation view of the folded arrangement may be an identical image of the right side elevation view of the folded arrangement).
Figure 26:
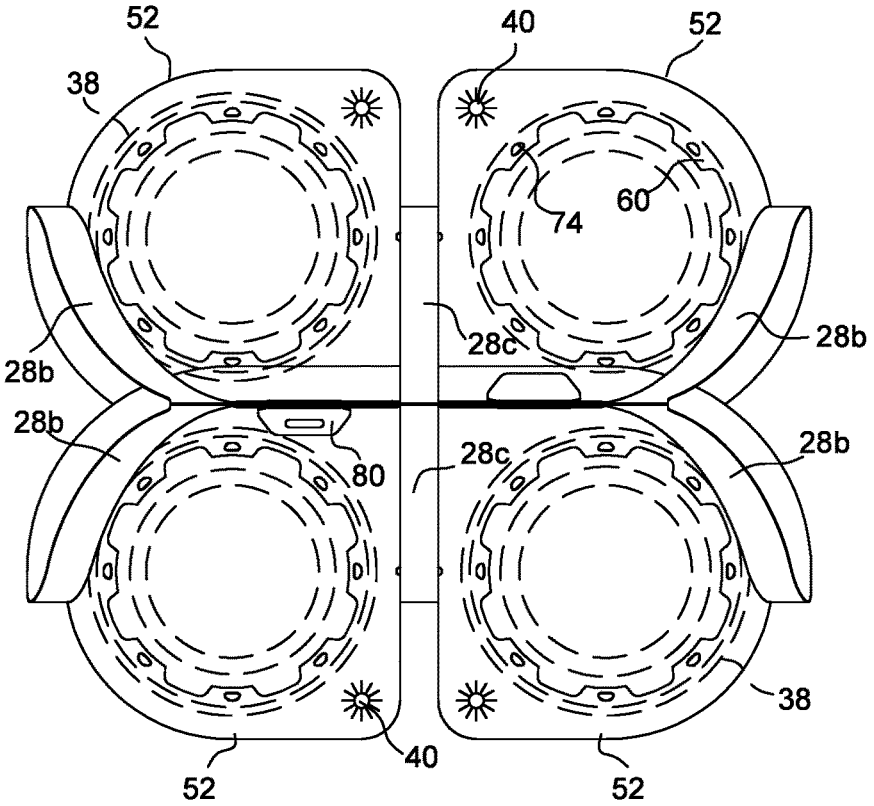
FIG. 26 is a top plan view of the quadruple cup carrier of FIG. 24, shown in a folded arrangement with a handle portion arranged in a transverse direction to a cup-holding portion.
Figure 27:
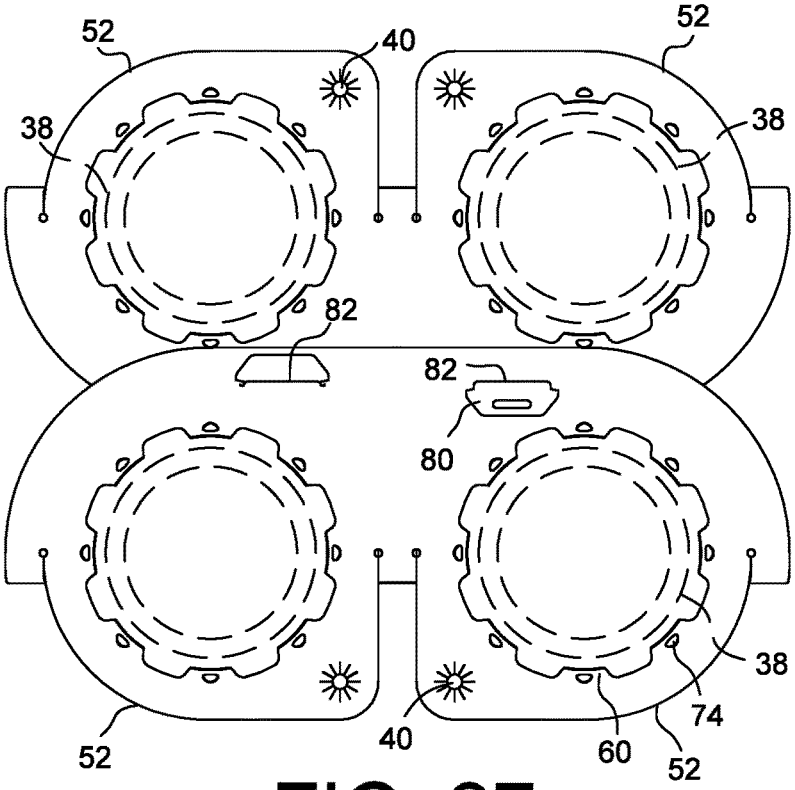
FIG. 27 is bottom view of the quadruple cup carrier of FIG. 24, shown in a folded arrangement with a handle portion arranged in a transverse direction to a cup-holding portion.
Figure 28:
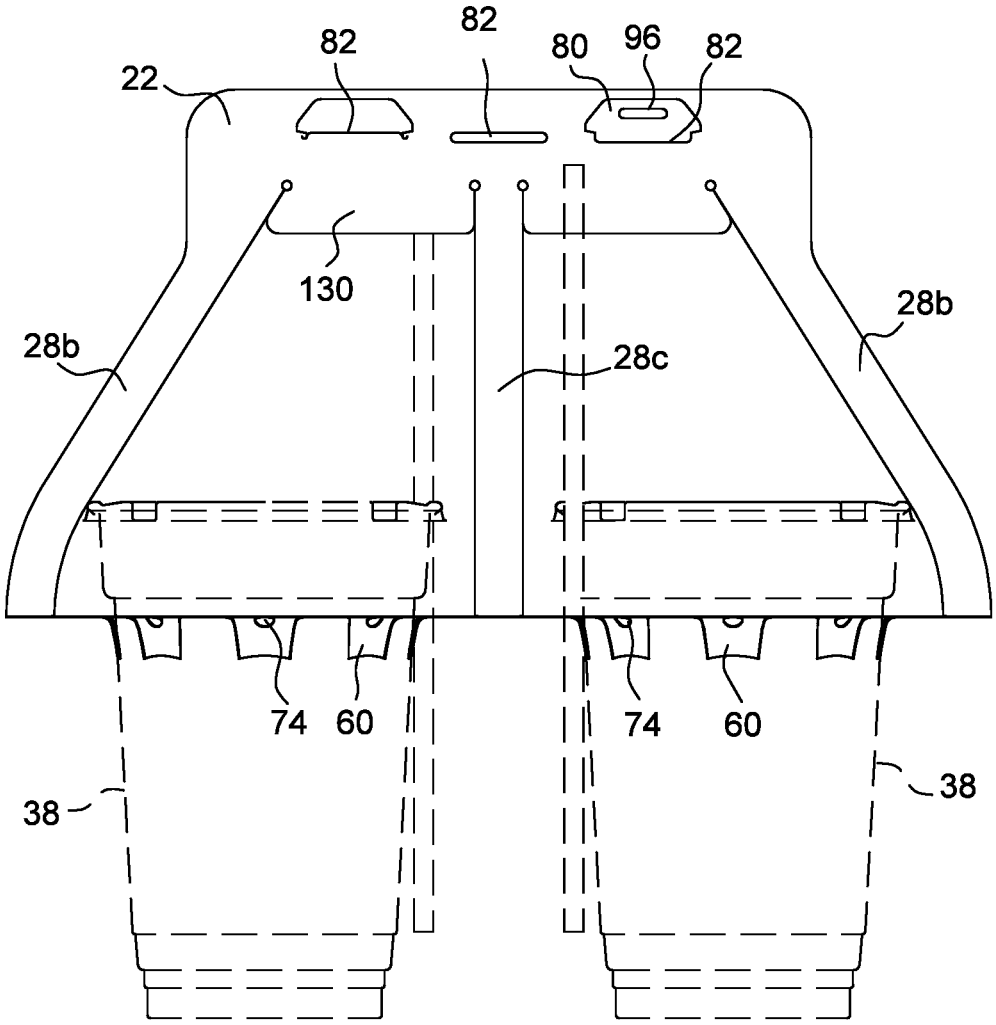
FIG. 28 is a front elevation view of the quadruple cup carrier of FIG. 24, shown in a folded arrangement with a handle portion arranged in a transverse direction to a cup-holding portion (and the rear elevation view of the folded arrangement may be an identical image of the front elevation view of the folded arrangement).

FIG. 24 is an isometric view showing an embodiment of a quadruple cup carrier 20*d*, shown in a folded arrangement with the handle portions 22 arranged in a transverse direction to the base portions 24 that include a total of four cup-holding portions 26; FIG. 25 is a right side elevation view of the quadruple cup carrier 20*d* of FIG. 24, shown in a folded arrangement with the handle portions 22 arranged in a transverse direction to the base portions 24 (and the left side elevation view of the folded arrangement may be an identical image of the right side elevation view of the folded arrangement); FIG. 26 is a top plan view of the quadruple cup carrier 20*d* of FIG. 24, shown in a folded arrangement with the handle portions 22 arranged in a transverse direction to the base portions 24; FIG. 27 is bottom view of the quadruple cup carrier 20*d* of FIG. 24, shown in a folded arrangement with the handle portions 22 arranged in a transverse direction to the base portions 24; and FIG. 28 is a front elevation view of the quadruple cup carrier 20*d* of FIG. 24, shown in a folded arrangement with the handle portions 22 arranged in a transverse direction to the base portions 24 (and the rear elevation view of the folded arrangement may be an identical image of the front elevation view of the folded arrangement).

With reference to FIGS. 24-28, a first double cup carrier 20*b* can be connected to a second double cup carrier 20*b* to produce the quadruple cup carrier 20*d*, which has four-cup holding portions 26. Assembly of the double cup carrier 20*d* may involve connecting the base fasteners 34 of the first double cup carrier 20*b* to the mated base fasteners 34 of the second double cup carrier 20*b*. For example, the tabs 80 can be inserted into the slots 82 until the notches 94 pass through the slots 82 and secure the tabs 80 in place. Similarly, the handle fastener(s) 120 of the first double cup carrier 20*b* may be connected to the mated handle fastener(s) 120 of the second double cup carrier 20*b*. Even though it might prove easier to start by connecting the base fasteners 34, one will appreciate that the handle fastener(s) 120 could be connected first.

The assortment of cup carriers 20*a*, 20*b*, 20*c*, and 20*d* allows a drink distributor to tailor the cup carrier 20 to the number of drinks that need to be transported. In particular, because cup carriers 20 and 20*b* are connectable, a cup carrier 20 with an odd number of cup-holding apertures 36 can be provided.

These cup carriers 20 can be manufactured economically. They can be printed on location in the correct numbers needed, and/or they can be stacked without taking up much space. They can be manufactured as clear sheets or they can be manufactured in colored sheets with logos or advertising printed directly on the sheets. The cup carriers 20 may all be in one color or they may be manufactured to provide several covers. In some embodiments, the cup carriers 20*a* and the cup carriers 20*b* can be manufactured to have different colors so that they are more readily distinguishable.

CONCLUSION

The terms and descriptions used above are set forth by way of illustration and example only and are not meant as limitations. Those skilled in the art will recognize that many variations, enhancements and modifications of the concepts described herein are possible without departing from the underlying principles of the invention. For example, skilled persons will appreciate that the subject matter of any sentence or paragraph can be combined with subject matter of some or all of the other sentences or paragraphs, except where such combinations are mutually exclusive. The scope of the invention should therefore be determined only by the following claims, claims presented in a continuation patent application, and equivalents to the foregoing claims.

The invention claimed is:

1. A set of cup carriers, comprising:

a first cup carrier comprising a first flexible sheet of material including a first base portion connected by multiple first straps to a first handle portion, one or more first cup-holding portions formed in the first base portion, a first cup-holding aperture formed through the material forming each of the one or more first cup-holding portions, one or more first base fasteners formed within the first base portion, and one or more first handle fasteners formed within the first handle portion; and a second cup carrier comprising a second flexible sheet of material including a second base portion connected by multiple second straps to a second handle portion, one or more second cup-holding portions formed in the second base portion, a second cup-holding aperture formed within each of the one or more second cup-holding portions, one or more second base fasteners formed through the material forming the second base portion, and one or more second handle fasteners formed within the second handle portion, wherein one of the first base fasteners is configured to be connectable to one of the second base fasteners, and wherein one of the first handle fasteners is configured to be connectable to one of the second handle fasteners.

2. The set of cup carriers of claim 1, wherein the first cup carrier and the second cup carrier have a different number of cup-holding apertures.

3. The set of cup carriers of claim 1, wherein the first cup carrier and the second cup carrier have the same number of cup-holding apertures.

4. The set of cup carriers of claim 1, wherein the first cup carrier and the second cup carrier have a total number of cup-holding apertures that is an odd number.

5. The set of cup carriers of claim 1, wherein the first and second cup carriers are non-identical.

6. The set of cup carriers of claim 1, wherein the sheet of material has a thickness of 0.2 mm to 0.5 mm.

7. The set of cup carriers of claim 1, wherein the sheet of material comprises a substantially uniform thickness.

8. The set of cup carriers of claim 1, wherein the sheet of material comprises different thicknesses.

9. The set of cup carriers of claim 1, wherein the sheet of material comprises a recyclable material, a biodegradable material, a marine-degradable material, or a material that is edible by an animal, mammal, a livestock animal, or a human.

10. The set of cup carriers of claim 1, wherein the first cup carrier is formed from a 3D printed material, is formed from a molding process, or is cut from an elongated sheet of material.

11. The set of cup carriers of claim 1, wherein the first cup carrier includes only one first cup-holding portion.

12. The set of cup carriers of claim 1, wherein the first cup carrier includes multiple first cup-holding portions.

13. The set of cup carriers of claim 1, wherein the first cup carrier includes only one first cup-holding portion, and wherein the second cup carrier includes multiple second cup-holding portions.

14. The set of cup carriers of claim 1, wherein the first and second handle fasteners comprise different ones of a mated pair of fasteners.

15. The set of cup carriers of claim 1, wherein the first and second base fasteners comprise different ones of a mated pair of fasteners.

16. The set of cup carriers of claim 1, wherein the first handle portion comprises at least two different configurations of fasteners.

17. The set of cup carriers of claim 1, wherein the first base portion comprises at least two different configurations of fasteners.

18. The set of cup carriers of claim 1, wherein the first and second handle fasteners or the first and second base fasteners comprise different ones of tabs and slots.

19. The set of cup carriers of claim 1, wherein the first handle portion or the first base portion comprises different ones of tabs and slots.

20. The set of cup carriers of claim 1, wherein each cup-holding aperture defines multiple cup-holding flaps, wherein each cup-holding aperture defines multiple aperture recesses, and wherein each cup-holding portion comprises one or more fold holes between neighboring aperture recesses.

21. The set of cup carriers of claim 1, wherein each cup-holding aperture defines multiple cup-holding flaps and multiple aperture recesses, wherein each of the cup-holding flaps has a top, wherein each of the aperture recesses has a bottom, and wherein each cup-holding portion comprises a fold hole that is closer to the bottoms of neighboring aperture recesses than it is to the tops of neighboring cup-holding flaps.

22. The set of cup carriers of claim 1, wherein each base portion or each handle portion contains a printed advertisement.

23. The set of cup carriers of claim 1, wherein the first and second cup carriers are selected from a group of cup carriers including single cup carriers having one cup-holding aperture and double cup carriers having two cup-holding apertures, and wherein the cup-holding apertures exhibit a substantially circular cup-holding aperture profile when holding a cup.

24. The set of cup carriers of claim 1, wherein the first and second cup carriers are configured to be connected to each other such that one of the first base fasteners is connected to one of the second base fasteners, wherein the first base portion and the second base portion are configured to lie in substantially similar planes when connected, wherein the first base fasteners and the second base fasteners are configured to intersect each other in the substantially similar planes, and wherein one of the first handle fasteners is configured to be connected to one of the second handle fasteners.

25. The set of cup carriers of claim 1, wherein the first base portion is connected exclusively by the multiple first straps to the first handle portion, and wherein the second base portion is connected exclusively by the multiple second straps to the second handle portion.

26. The set of cup carriers of claim 1, wherein the first and second straps have a strap width that is shorter than the strap length.

27. The set of cup carriers of claim 1, wherein the first and second cup-holding apertures have a cup-holding profile that is configured to engage a cup by surrounding and contacting a majority of a circumference along an outer side wall of the cup.

28. The set of cup carriers of claim 1, wherein the multiple first straps are predisposed to curve away from the multiple second straps when the first base fasteners are connected to the second base fasteners and the first handle fasteners are connected to the second handle fasteners.

29. The set of cup carriers of claim 1, wherein a first lower portion one or more of the multiple first straps and a second lower portion of one or more of the multiple second straps are predisposed so that respective planes in their respective width dimensions are oriented transversely across the respective first and second cup-holding apertures.

30. The set of cup carriers of claim 1, wherein the multiple first straps connect the first base portion to the first handle portion when the first base portion and the first handle portion are in the same plane.

31. The set of cup carriers of claim 1, wherein one of the first base fasteners is configured to be connectable to one of the second base fasteners along a line between the first cup-holding aperture and the second cup-holding aperture, and wherein a first lower portion one or more of the multiple first straps and a second lower portion of one or more of the multiple second straps are predisposed to be spaced apart from planes containing the first and second handle portions when the first base fasteners are connected to the second base fasteners and the first handle fasteners are connected to the second handle fasteners.

32. A method for assembling a composite cup carrier, comprising:

obtaining a first cup carrier comprising a first flexible sheet of material including a first base portion connected by multiple first straps to a first handle portion, one or more first cup-holding portions formed in the first base portion, a first cup-holding aperture formed through the material forming each of the one or more first cup-holding portions, one or more first base fasteners formed within the first base portion, and one or more first handle fasteners formed within the first handle portion;

obtaining a second cup carrier comprising a second flexible sheet of material including a second base portion connected by multiple second straps to a second handle portion, one or more second cup-holding portions formed in the second base portion, a second cup-holding aperture formed through the material forming each of the one or more second cup-holding portions, one or more second base fasteners formed within the second base portion, and one or more second handle fasteners formed within the second handle portion, wherein one of the first base fasteners is configured to be connectable to one of the second base fasteners, and wherein one of the first handle fasteners is configured to be connectable to one of the second handle fasteners;

connecting the first and second base fasteners; and connecting the first and second handle fasteners to form the composite cup carrier.

* * * * *